US009210981B2

(12) United States Patent
Mizuno et al.

(10) Patent No.: US 9,210,981 B2
(45) Date of Patent: Dec. 15, 2015

(54) AUTOMATIC HEAD CARE DEVICE AND AUTOMATIC HEAD CARE METHOD

(71) Applicant: Panasonic Corporation, Osaka (JP)

(72) Inventors: Osamu Mizuno, Nara (JP); Tohru Nakamura, Osaka (JP); Soichiro Fujioka, Osaka (JP); Toshinori Hirose, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 93 days.

(21) Appl. No.: 14/346,266

(22) PCT Filed: Sep. 25, 2012

(86) PCT No.: PCT/JP2012/006101
§ 371 (c)(1),
(2) Date: Mar. 20, 2014

(87) PCT Pub. No.: WO2013/046646
PCT Pub. Date: Apr. 4, 2013

(65) Prior Publication Data

US 2014/0238429 A1 Aug. 28, 2014

(30) Foreign Application Priority Data

Sep. 30, 2011 (JP) ..... 2011-216350

(51) Int. Cl.

| | |
|---|---|
| ***A45D 19/08*** | (2006.01) |
| ***A45D 19/14*** | (2006.01) |
| ***A45D 19/10*** | (2006.01) |
| ***A61H 7/00*** | (2006.01) |
| ***A61H 15/00*** | (2006.01) |
| ***A61H 35/00*** | (2006.01) |

(52) U.S. Cl.
CPC ..... *A45D 19/14* (2013.01); *A45D 19/08* (2013.01); *A45D 19/10* (2013.01); *A61H 7/004* (2013.01); *A61H 15/0078* (2013.01); *A61H 35/008* (2013.01); *A61H 2201/0192* (2013.01); *A61H 2201/1215* (2013.01);
(Continued)

(58) Field of Classification Search
CPC ..... A45D 19/10
USPC ..... 4/515–523
See application file for complete search history.

(56) References Cited

FOREIGN PATENT DOCUMENTS

| | | | |
|---|---|---|---|
| CN | 1653983 | A | 8/2005 |
| JP | 06-021636 | U | 3/1994 |

(Continued)

OTHER PUBLICATIONS

Translation of the International Preliminary Report on Patentability corresponding to PCT/JP2012/006101, dated Apr. 8, 2014.

(Continued)

*Primary Examiner* — Lori Baker
(74) *Attorney, Agent, or Firm* — Renner, Otto, Boisselle & Sklar, LLP

(57) ABSTRACT

An automatic head care device includes independently rotated first rotational driving shaft and second rotational driving shaft, a first link having one end fixed to the first rotational driving shaft, a second link having one end rotatably connected to another end of the first link, a third link having one end fixed to the second rotational driving shaft, a fourth link having one end rotatably connected to another end of the third link, a working shaft rotatably connecting another end of the second link to another end of the fourth link, a working body caring the person's head, the working body being rotatably supported by the working shaft, and a control unit controlling rotation of the first rotational driving shaft and the second rotational driving shaft.

16 Claims, 20 Drawing Sheets

(52) U.S. Cl.
CPC ..... *A61H 2201/1463* (2013.01); *A61H 2201/1607* (2013.01); *A61H 2201/1671* (2013.01); *A61H 2201/1676* (2013.01); *A61H 2201/1692* (2013.01); *A61H 2201/5007* (2013.01)

(56) References Cited

FOREIGN PATENT DOCUMENTS

| | | | |
|---|---|---|---|
| JP | 06-078821 | A | 3/1994 |
| JP | 07-236511 | A | 9/1995 |
| JP | 2001-149133 | A | 6/2001 |
| JP | 2003-245119 | A | 9/2003 |
| JP | 2010/178979 | A | 8/2010 |

OTHER PUBLICATIONS

International Search Report for corresponding International Application No. PCT/JP2012/006101 mailed Dec. 25, 2012.

Form PCT/ISA/237 for corresponding International Application No. PCT/JP2012/006101 dated Dec. 25, 2012.

Chinese Office Action corresponding to Chinese Application No. 201280042280.1 dated Aug. 21, 2015 with English translation of Office Action and Search Report.

100

220c
216
217
218
220a
220b
219
219
12R
12L
111R
110
111L
213R
213L
211R
211L
108R
109
108L
105R
105L
106R
106L
107R
107L
210R
210L
204R
204L
102R
102L
209R
214R
214L
209L
201R
201L
104R
103R
103L
104L
202R
202L
203R
203L
10
Y
Z
X
400

AUTOMATIC HEAD CARE DEVICE AND AUTOMATIC HEAD CARE METHOD

TECHNICAL FIELD

The present invention relates to an automatic head care device and an automatic head care method automatically caring a person's head in a medical field or beauty care industry.

BACKGROUND OF THE INVENTION

An example of person's head care is washing of a person's head. In the industry of beauty care including hair styling and hair cutting, head washing including hair is laborious and has been desired to be automated. Also in the medical field, head washing for inpatients is laborious and has been desired to be automated.

There has been known a device disclosed in Patent Document 1, for example, for washing person's hair automatically.

FIG. 20 is a view showing a schematic configuration of a main section of a conventional automatic head washing device. As shown in FIG. 20, comb-like projections 2 are provided at regular intervals of the inner circumference of an arcuate washing unit 1 of the conventional automatic head washing device. A scalp washing nozzle 2*a* is provided at a tip of each of the comb-like projections 2, and a hair washing nozzle 1*a* is provided between the comb-like projections 2. These nozzles 1*a* and 2*a* are connected to an ejected liquid switching unit 3 via a liquid feeding path provided in the washing unit 1. The automatic head washing device ejects cleaning agent or washing agent to scalp and hair from the nozzles 1*a* and 2*a* to wash a person's head.

The washing unit 1 is driven by a washing-unit reciprocation driving section 4 via a rack 4*a* and a pinion 4*b* to be movable in the directions of an arrow 4*c*. With this configuration, the washing unit 1 extends a washing area of scalp and hair. The washing unit 1, the ejected liquid switching unit 3, and the washing-unit reciprocation driving section 4 are supported by a washing-unit supporting section 5. The washing-unit supporting section 5 is driven by a washing-unit rotational driving section 6 via a gear 8, and is rotatable about a spindle 7.

In the automatic head washing device, the ejected liquid switching unit 3, the washing-unit reciprocation driving section 4, and the washing-unit rotational driving section 6 are controlled in cooperation to perform the head washing operation. The use of the automatic head washing device enables washing of scalp and hair all over a person's head automatically, eliminating manual work.

Patent Document 1: JP 2001-149133 A

However, the above-mentioned conventional automatic head washing device washes the entire person's head by use of the nozzles fixed to one washing unit. For this reason, when the washing unit does not correspond to a person's head in shape or size, the washing unit nonuniformly contacts the person's head, resulting in that scalp and hair of the person's head cannot be completely washed, failing to acquire a satisfactory washing effect.

An object of the present invention is to provide an automatic head care device and an automatic head care method that can reliably care a person's head according to the shape or size of the person's head even when the washed person changes and accordingly, the person's head changes in shape or size.

SUMMARY OF THE INVENTION

To attain the object, an automatic head care device of the present invention includes: a base having a head support supporting a person's head; independently rotated first rotational driving shaft and second rotational driving shaft, a first link having one end fixed to the first rotational driving shaft; a second link having one end rotatably connected to another end of the first link; a third link having one end fixed to the second rotational driving shaft; a fourth link having one end rotatably connected to another end of the third link; a working shaft rotatably connecting another end of the second link to another end of the fourth link; a working body caring the person's head supported by the head support, the working body being rotatably supported by the working shaft; and a control unit controlling rotation of the first rotational driving shaft and the second rotational driving shaft.

To attain the object, an automatic head care method of the present invention is an automatic head care method using an automatic head care device including: a base having a head support supporting a person's head; independently rotated first rotational driving shaft and second rotational driving shaft; a first link having one end fixed to the first rotational driving shaft; a second link having one end rotatably connected to another end of the first link; a third link having one end fixed to the second rotational driving shaft; a fourth link having one end rotatably connected to another end of the third link; a working shaft rotatably connecting another end of the second link to another end of the fourth link; a working body rotatably supported by the working shaft; an arm base rotatably holding the first rotational driving shaft and the second rotational driving shaft; and a support shaft fixed to the arm base, the support shaft being rotatably attached to the base, the method comprising controlling rotation of the first rotational driving shaft and the second rotational driving shaft to cause the working body to make contact with the person's head supported by the head support, thereby caring the person's head.

Advantage of the Invention

An automatic head care device and an automatic head care method of the present invention can reliably care a person's head according to the shape or size of the person's head even when the person's head changes in shape or size.

EMBODIMENTS OF THE INVENTION

Embodiments of the present invention will be described below with reference to the drawings. The same constituents are given the same reference symbols and description thereof may be omitted. To be easy to understand, the drawings schematically show each of the constituents. These drawings appropriately show a Z axis along the vertical direction, and X axis and Y axis perpendicular to the Z axis.

According to the present invention, an automatic head washing device automatically washing a person's head of a washed person will be described as an example of an automatic head care device automatically a caring person's head. The expression "caring a person's head" according to the present invention refers to at least one of washing of scalp of a person's head, washing hair of a person's head (hair washing), and massage of a person's head. In following description of the embodiments, "left", "right", "front" or "rear" refers to the direction when viewed from the person whose head is washed.

First Embodiment

Figure 1:
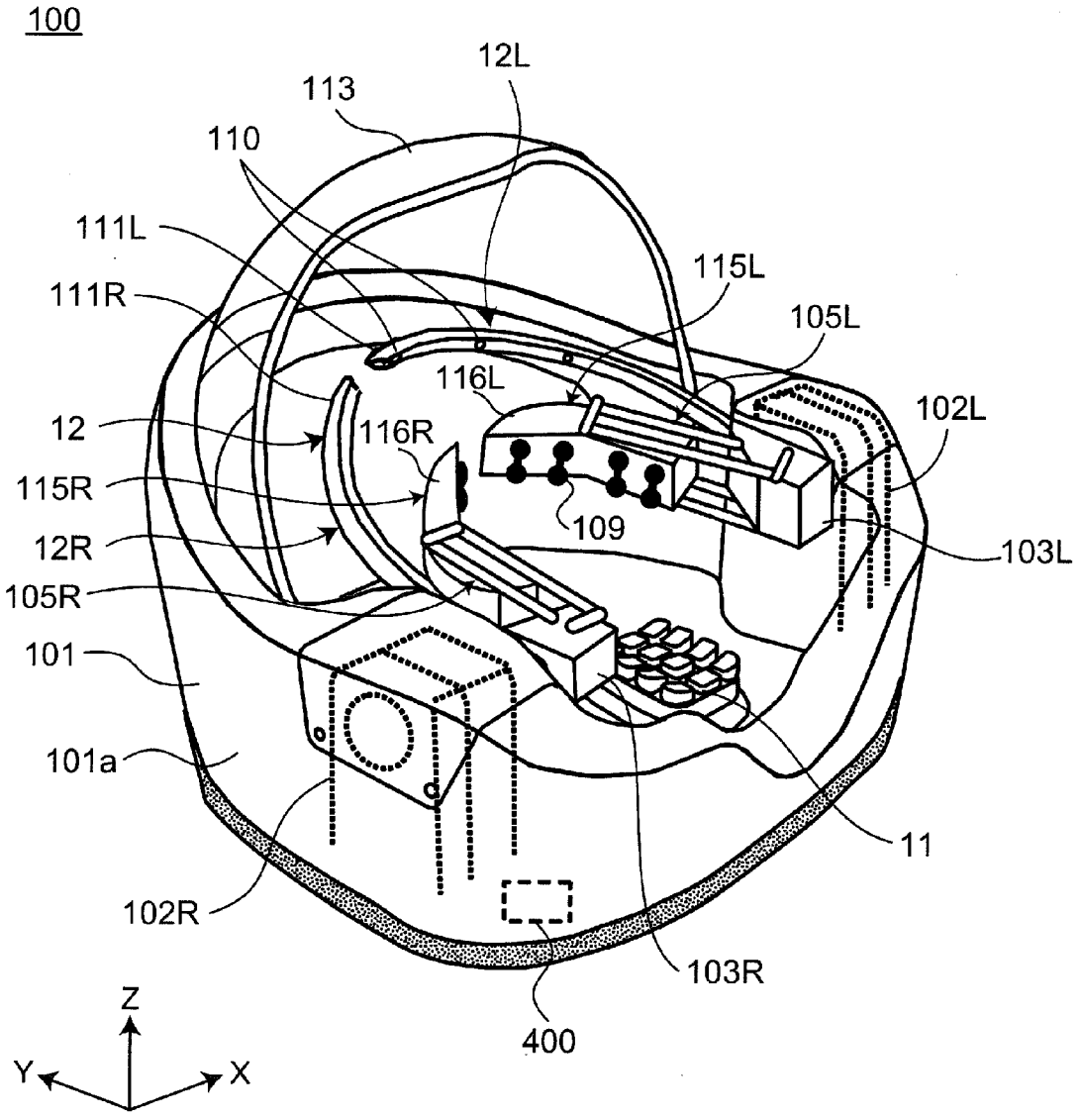
FIG. 1 is a perspective view of an automatic head washing device in accordance with a first embodiment of the present invention.
Figure 2:
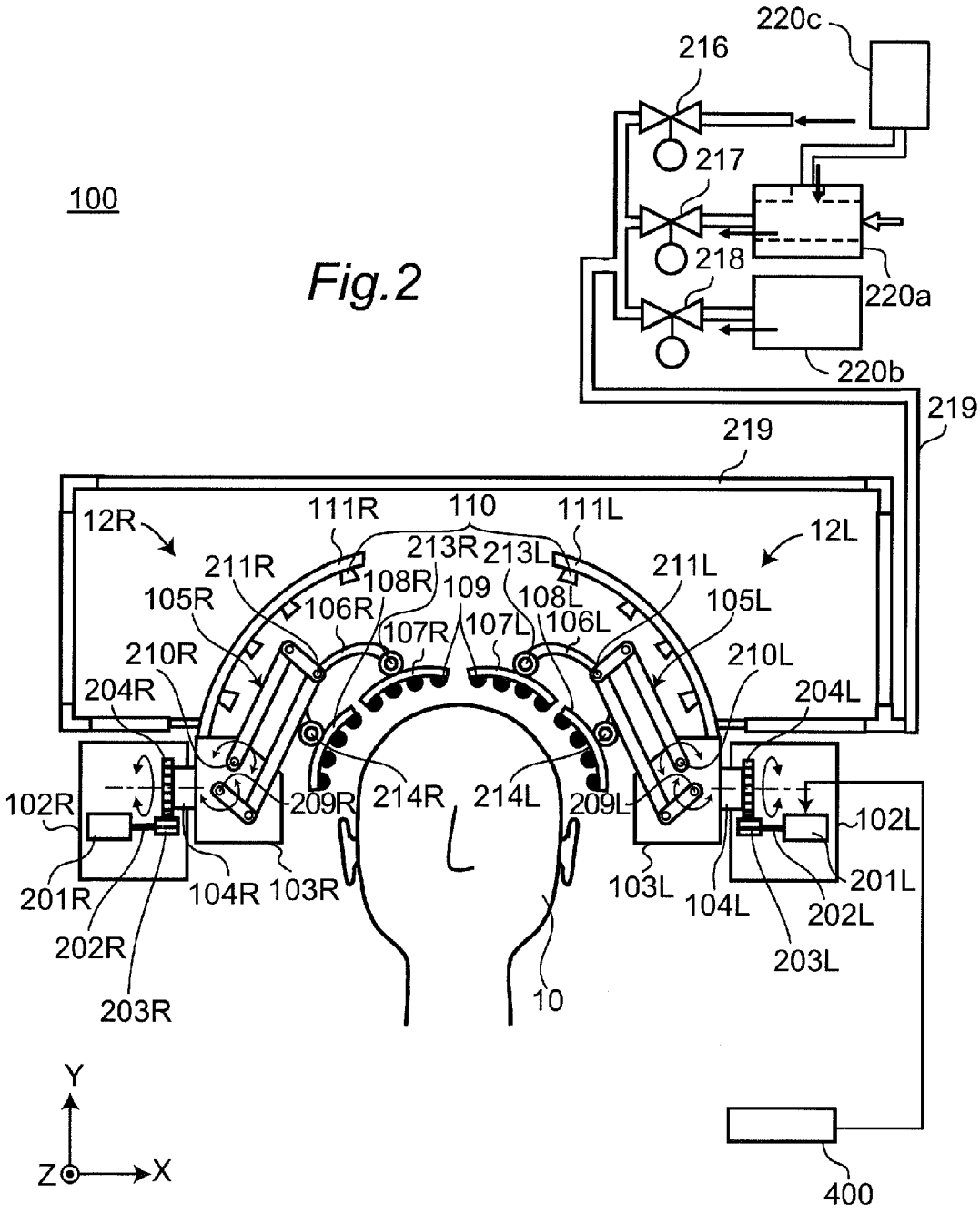
FIG. 2 is a view showing a configuration of a first main section of a drive mechanism of the automatic head washing device in accordance with the first embodiment.

FIG. 1 is a perspective view showing an automatic head washing device in accordance with a first embodiment of the present invention. FIG. 2 is a view showing a configuration of a first main section of a drive mechanism of the automatic head washing device in accordance with the first embodiment.

As shown in FIG. 1, an automatic head washing device 100 in accordance with the first embodiment has a bowl 101. The bowl 101 is an example of a base having a head support 11 supporting a head 10 of the washed person. The bowl 101 is configured to surround a substantially half of a rear part of the person's head 10. Support columns 102L and 102R are mounted in a housing 101*a* constituting the bowl 101. The support columns 102L and 102R are located on left and right sides of the head support 11, respectively, across the head support 11 in the bowl 101.

The automatic head washing device 100 has a pair of two washing arms 12 washing the person's head 10 supported in the bowl 101. The pair of washing arms 12 are configured of a left washing arm 12L and a right washing arm 12R, which are disposed across the head support 11 in the bowl 101. The bowl 101 is provided with a hood 113 preventing scattering of water during washing.

The washing arm 12L has a working body 115L washing the person's head 10, a first arm 105L rotatably supporting the working body 115L, an arm base 103L to which the first arm 105L is attached, a support shaft 104L fixed to the arm base 103L, and a pipe 111L fixed to the arm base 103L. The working body 115L is an example of a working body caring the person's head 10. The pipe 111L is an example of piping.

As shown in FIG. 2, in the washing arm 12L, the support shaft 104L is rotatably coupled to the support column 102L, and can rotate about the support shaft 104L. That is, in the washing arm 12L, the support shaft 104L is rotatably attached to the bowl 101 via the support column 102L, and can rotate about the support shaft 104L.

A motor 201L is disposed in the support column 102L. A rotation output of the motor 201L is transmitted to the support shaft 104L via a gear 203L attached to a motor rotation output shaft 202L and a gear 204L attached to the support shaft 104L. The arm base 103L fixed to the support shaft 104L is driven by the rotation output transmitted from the motor 201L to be rotatable about the support shaft 104L. Driving of the motor 201L is controlled by a control unit 400.

The pipe 111L of the washing arm 12L has a plurality of nozzles 110 ejecting at least one of water, hot water, washing agent, or conditioner. The nozzles 110 are formed on an opposed surface of the pipe 111L. The opposed surface of the pipe 111L is a surface of the pipe 111L, which faces the head support 11. The pipe 111L is attached to the arm base 103L, and can rotate about the support shaft 104L together with the arm base 103L.

As shown in FIG. 2, the automatic head washing device 100 includes a water system valve 216, a washing agent system valve 217, and a conditioner system valve 218. Outlets of the water system valve 216, the washing agent system valve 217, and the conditioner system valve 218 are connected to one another in parallel, and are connected to the pipe 111L and a pipe 111R via piping 219.

An inlet of the water system valve 216 is connected to a water system supplying unit to receive water or hot water from the water system supplying unit. An inlet of the washing agent system valve 217 is connected to a mixing unit 220*a* mixing washing agent and compressed air to receive mousse-like washing agent. The mousse-like washing agent supplied to the washing agent system valve 217 is produced by mixing washing agent and compressed air in the mixing unit 220*a*, the washing agent from a washing agent supplying unit 220*c* supplying washing agent such as shampoo. An inlet of the conditioner system valve 218 is connected to a conditioner supplying unit 220*b* to receive conditioner (for example, rinse) from the conditioner supplying unit 220*b*.

The control unit 400 of the automatic head washing device 100 appropriately control the water system valve 216, the washing agent system valve 217, and the conditioner system valve 218 to cause the plurality of nozzles 110 provided on the pipes 111L and 111R to eject water, hot water, mousse-like washing agent, or conditioner.

The water supplying unit supplying water or hot water to the washing arms 12L and 12R is configured of the water system supplying unit and the water system valve 216. The washing agent supplying unit supplying washing agent to the washing arms 12L and 12R is configured of the washing agent supplying unit 220*c*, the mixing unit 220*a*, and the washing agent system valve 217. The conditioner supplying unit supplying conditioner to the washing arms 12L and 12R is configured of the conditioner supplying unit 220*b* and the conditioner system valve 218.

The working body 115L of the washing arm 12L includes a second arm 106L rotatably supported by the first arm 105L through a support shaft 211L, a third arm 107L rotatably supported by the second arm 106L through a support shaft 213L, a third arm 108L rotatably supported by the second arm 106L through a support shaft 213L, and a housing 116L covering the second arm 106L and the third arms 107L and 108L.

The second arm 106L has a predetermined shape, such as, substantially arcuate shape and substantially linear shape. The second arm 106L rotatably supports the third arm 107L through the support shaft 213L at one end, and rotatably supports the third arm 108L through a support shaft 214L at the other end. The two third arms 107L and 108L are supported by the second arm 106L so as to be substantially symmetric about the support shaft 211L.

An elastic body such as spring is provided between the second arm 106L and the first arm 105L to hold the second arm 106L at a predetermined position with respect to the first arm 105L. The elastic body restricts positional relationship between the second arm 106L and the first arm 105L, between the second arm 106L and the first arm 105L. For example, the elastic body is configured to couple the second arm 106L to the support shaft 211L of the first arm 105L. In place of the elastic body, means automatically aligning the second arm 106L with the first arm 105L may be used.

Elastic bodies such as springs are provided between the third arm 107L and the second arm 106L, and between the third arm 108L and the second arm 106L to hold the third arms 107L and 108L at respective predetermined positions with respect to the second arm 106L. The elastic bodies are between the third arm 107L and the second arm 106L and between the third arm 108L and the second arm 106L, and restrict positional relationship therebetween. For example, the elastic bodies are provided to couple the third arms 107L and 108L to the support shafts 213L and 214L of the second arm 106L, respectively. In place of the elastic bodies, means automatically aligning the third arms 107L and 108L with the second arm 106L may be used.

A plurality of contacts 109 that make contact with the person's head 10 supported by the head support 11 are attached to each of the third arms 107L and 108L. Specifically, contact units each having the plurality of contacts 109 at their front ends are rotatably supported by the third arms 107L and 108L, thereby swingably attaching the plurality of contacts 109 to each of the third arms 107L and 108L. The contacts 109 each are made of an elastic rubber material.

The working body 115 will be further described below with reference to FIG. 3 and FIG. 4.

Figure 3:
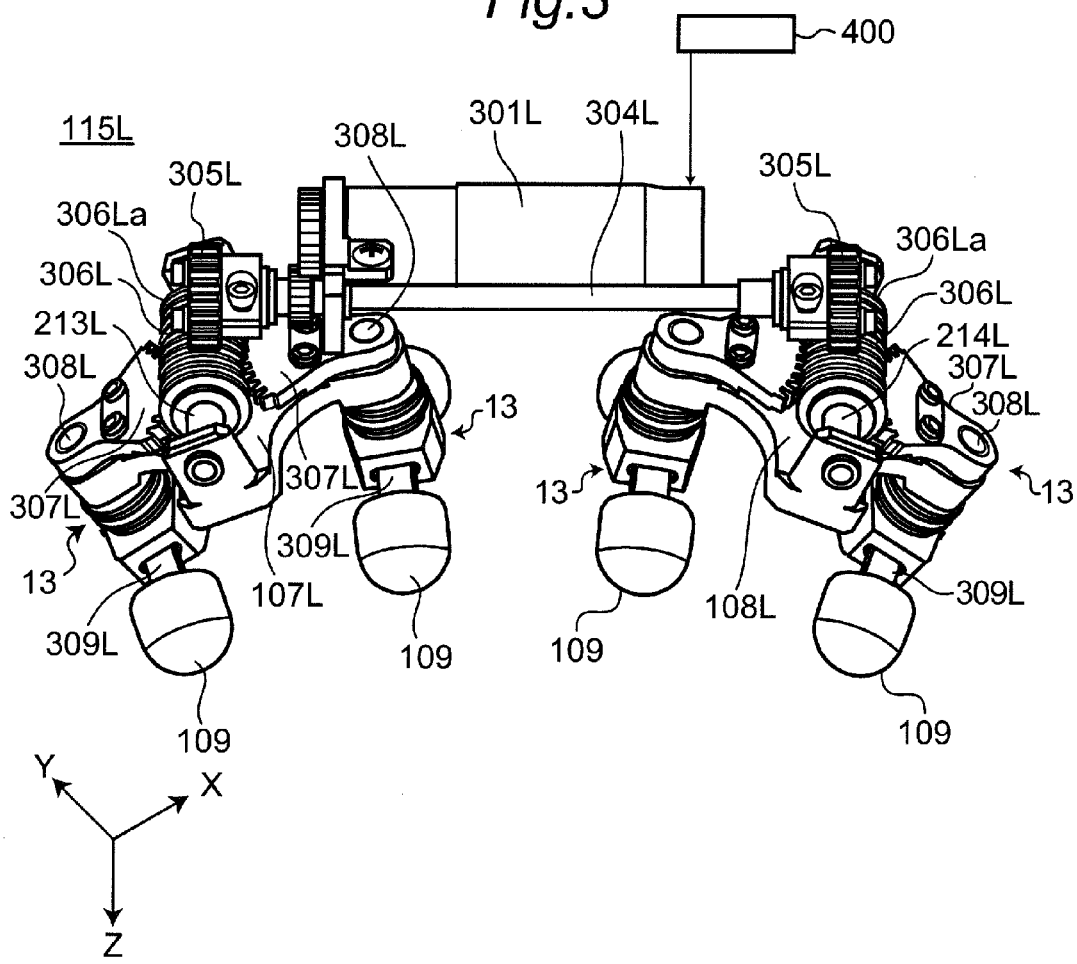
FIG. 3 is a perspective view showing a second main section of the drive mechanism of the automatic head washing device in accordance with the first embodiment.

FIG. 3 is a perspective view showing a second main section of the drive mechanism of the automatic head washing device in accordance with the first embodiment. In FIG. 3, the housing 116L and the second arm 106L of the working body 115L are not shown.

As shown in FIG. 3, the working body 115L includes, in the housing 116L, a motor 301L, a drive shaft 304L transmitting the output from the motor 301L, two cylindrical racks 306L, and four contact units 13. The two cylindrical racks 306L engage with respective gears 305L disposed on both ends of the drive shaft 304L. The four contact units 13 each have the two contacts 109 at their front ends, and a gear 307L engaged with the cylindrical rack 306L.

The cylindrical racks 306L are substantially cylindrical as a whole, and each include an axisymmetric rack mechanism 306La on a side surface thereof. The cylindrical racks 306L are each configured such that the rack mechanism 306La engages with the gear 305L attached to the drive shaft 304L as well as the gear 307L of the contact unit 13. The cylindrical racks 306L are rotatably supported by the support shafts 213L and 214L to be movable parallel to the support shafts 213L and 214L.

Figure 4:
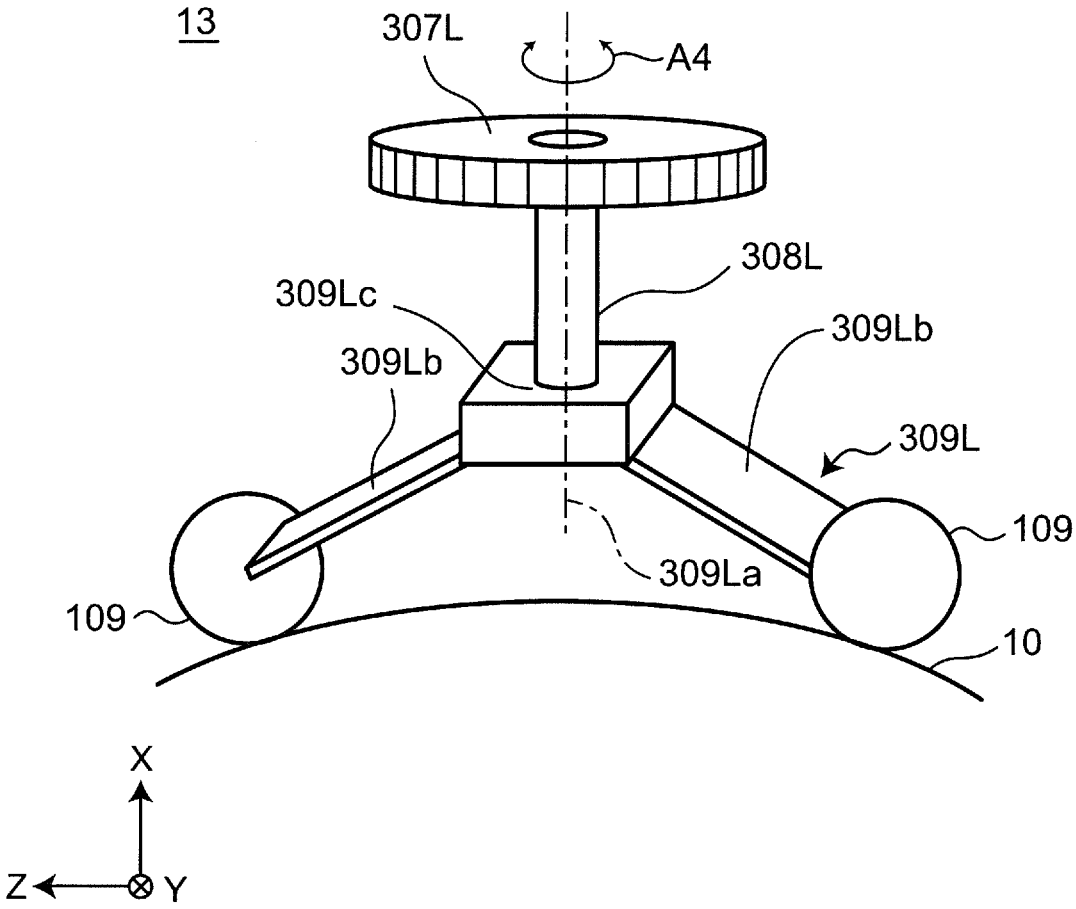
FIG. 4 is a perspective view showing a third main section of the drive mechanism of the automatic head washing device in accordance with the first embodiment.

FIG. 4 is a perspective view showing a third main section of the drive mechanism of the automatic head washing device in accordance with the first embodiment. FIG. 4 shows the contact unit 13. In FIG. 4, the gear 307L of the contact unit 13 is circular. As shown in FIG. 4, the contact unit 13 has a substantially V-like fourth arm 309L having the two contacts 109 at its front ends, and a rotation shaft 308L connected to the fourth arm 309L as well as to the gear 307L.

The fourth arm 309L has a pair of branches 309Lb and a connection 309Lc, and the connection 309Lc is connected to the rotation shaft 308L. The pair of branches 309Lb have the contacts 109 at their front ends, and are disposed symmetric about an axis of symmetry A4. The connection 309Lc couples the two branches 309Lb to each other at a top of the V-like branches 309Lb.

The fourth arm 309L is configured to include an elastic body in at least a part of an area ranging from the top of the V-like branches 309Lb to the contacts 109. In the fourth arm 309L of the contact unit 13 in FIG. 4, the branches 309Lb each function as a plate spring as an example of the elastic body.

The central axis of the rotation shaft 308L of the contact unit 13 corresponds to an axis of symmetry 309La of the fourth arm 309L. The contact unit 13 is supported by the third arm 107L such that the rotation shaft 308L can rotate. Thus, when the gear 307L rotates, the gear 307L and the contacts 109 integrally rotate about the rotation shaft 308L as represented by an arrow A4, and the contacts 109 swing about the rotation shaft 308L. The rotation shaft 308L is configured so as to maintain engagement between the cylindrical rack 306L and the gear 307L, for example, by including flanges in top and bottom portions across the third arm 107L.

As shown in FIG. 3, the two contact units 13 are attached to the third arm 107L. The two contact units 13 have the same configuration, and are disposed symmetric about the support shaft 213L. Similarly, the two contact units 13 are attached to the third arm 108L, and are disposed symmetric about the support shaft 214L.

In the working body 115L, the rotation output of the motor 301L is transmitted to the drive shaft 304L, and the cylindrical racks 306L are moved in the direction parallel to the support shafts 213L and 214L by the rotation output transmitted from the motor 301L to the drive shaft 304L, thereby causing each of the gears 307L to rotate about the rotation shaft 308L.

When the gear 307L rotates about the rotation shaft 308L, the two contacts 109 rotate integrally with the gear 307L, and the contacts 109 swing. The contacts 109 swing in contact with the person's head 10 to wash the person's head 10.

In the working body 115L, the second arm 106L and the third arms 107L and 108L are stored in the housing 116L. The contacts 109 attached to the third arms 107L and 108L are disposed outside the housing 116L. In the working body 115L, the support shaft 211L of the first arm 105L that rotatably supports the second arm 106L is rotatably attached to the housing 116L.

Figure 5:
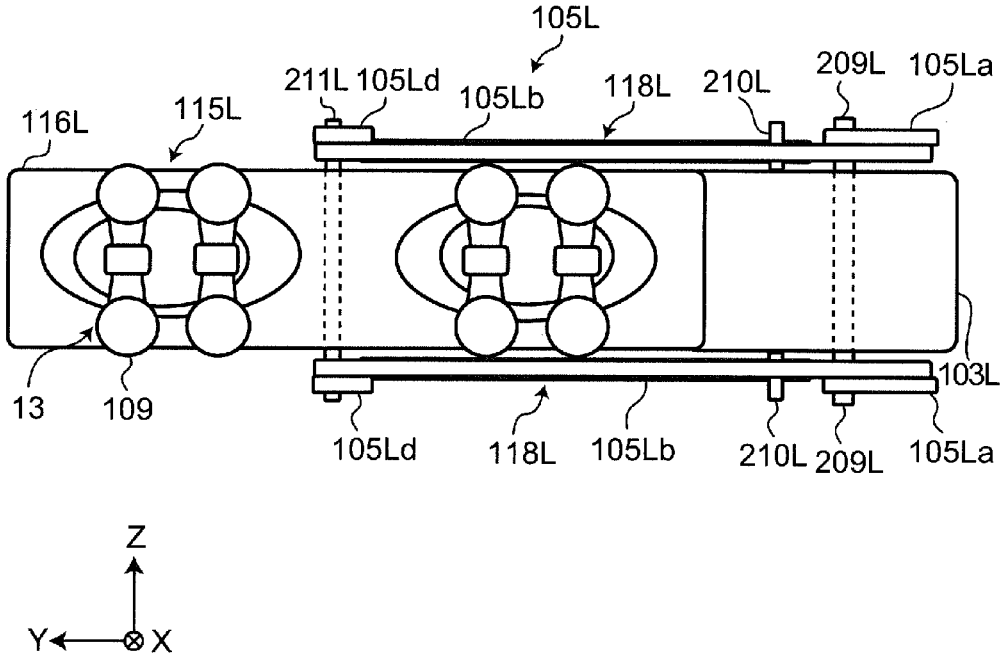
FIG. 5 is a view showing a washing arm of the automatic head washing device in accordance with the first embodiment when viewed from a washed person.
Figure 6:
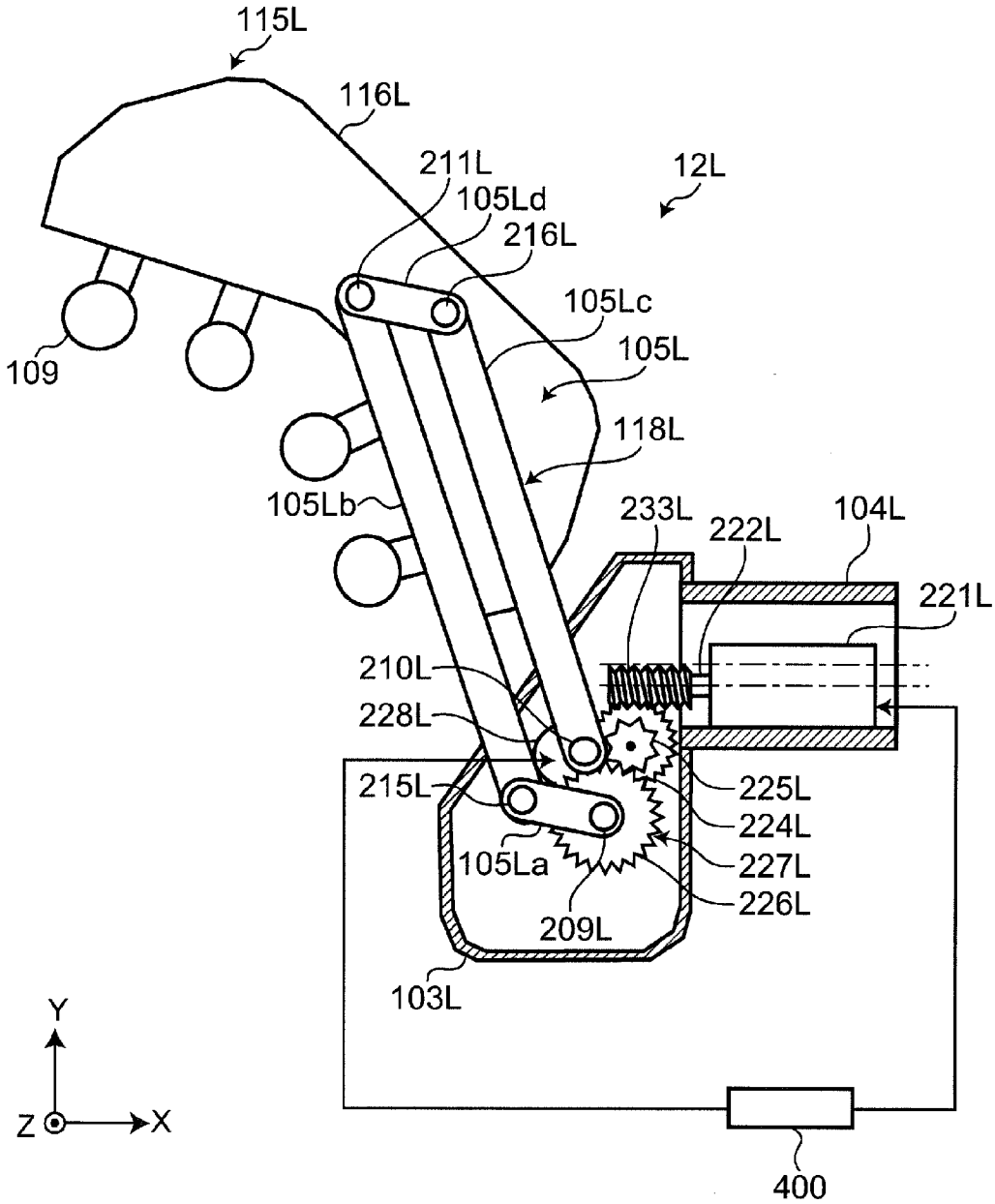
FIG. 6 is a side partial cutout view showing the washing arm of the automatic head washing device in accordance with the first embodiment.

FIG. 5 is a view showing the washing arm of the automatic head washing device in accordance with the first embodiment when viewed from the washed person. FIG. 6 is a side partial cutout view showing the washing arm of the automatic head washing device in accordance with the first embodiment. FIG. 6 shows the cutout arm base 103L and support shaft 104L of the washing arm 12L. In FIG. 5 and FIG. 6, the pipe 111L of the washing arm 12L is not shown.

As shown in FIG. 5 and FIG. 6, the first arm 105L of the washing arm 12L includes a first arm rotation shaft 209L as a first rotational driving shaft and a second arm rotation shaft 210L as a second rotational driving shaft, which are independently rotated. The first arm rotation shaft 209L and the second arm rotation shaft 210L each are rotatably held by the arm base 103L.

A rotational motor 221L as a first actuator that rotates the first arm rotation shaft 209L is disposed in the support shaft 104L of the washing arm 12L. The motor 221L is disposed in the cylindrical support shaft 104. An output shaft 222L of the motor 221L extends parallel to the support shaft 104L.

Since the output shaft 222L of the motor 221L is disposed in the support shaft 104L so as to extend parallel to the support shaft 104L, it is no need to dispose the motor 221L at the arm base 103L, and as compared to the case where the motor 221L is disposed at the arm base 103L, the arm base 103L can be made more compact. As a result, the bowl 101 can be reduced in size, miniaturizing the automatic head washing device 100.

A first conversion mechanism 227L is disposed in the arm base 103L. The first conversion mechanism 227L converts the motion of the output shaft 222L of the motor 221L into the rotation of the first arm rotation shaft 209L. The first conversion mechanism 227L has a worm 223L and a worm wheel 224L that convert the rotation of the output shaft 222L of the motor 221L into the rotation of the first arm rotation shaft 209L. The worm 223L is fixed to the output shaft 222L of the motor 221L.

The worm wheel 224L is provided so as to engage with the worm 223L. The first conversion mechanism 227L has a gear 225L coaxially fixed to the worm wheel 224L and a gear 226L that engages with the gear 225L and is coaxially fixed to the first arm rotation shaft 209L.

The first conversion mechanism 227L converts the rotation of the output shaft 222L of the motor 221 into the rotation of a first arm rotation shaft 229L via the worm 223L, the worm wheel 224L, the gear 225L, and the gear 226L. Driving of the motor 221L is controlled by the control unit 400.

The first conversion mechanism 227L is configured of the worm 223L and the worm wheel 224L. Accordingly, the first conversion mechanism 227L can convert the rotation of the output shaft 222L of the motor 221 into the rotation of the first arm rotation shaft 229L, but cannot convert the rotation of the first arm rotation shaft 229L into the rotation of the output shaft of the motor 221L. That is, the first conversion mechanism 227L has an irreversible function.

A motor 228L as a second actuator rotating the second arm rotation shaft 210L is disposed in the arm base 103L. A second conversion mechanism converting the rotation of the output shaft of the motor 228L into the rotation of the second arm rotation shaft 210L is disposed in the arm base 103L.

The second conversion mechanism has a first spur gear fixed to an output shaft of the motor 228L and a second spur gear that engages with the first spur gear and is coaxially fixed to the second arm rotation shaft 210L, and reversibly converts the rotation of the output shaft of the motor 228L into the rotation of the second arm rotation shaft. That is, the second conversion mechanism has a reversible function. Driving of the motor 228L is controlled by the control unit 400.

The first arm 105L includes two five-joint link mechanisms 118L and the support shaft 211L. The two five-joint link mechanisms 118L have the same shape, and as shown in FIG. 5, are disposed parallel to each other across the working body 115L. The support shaft 211L couples the two five-joint link mechanisms 118L to each other, and rotatably supports the working body 115L. The support shaft 211L is an example of a working shaft rotatably supporting the working body 115L.

The five-joint link mechanisms 118L each include a first link 105La having one end fixed to the first arm rotation shaft 209L, a second link 105Lb having one end rotatably connected to the other end of the first link 105La through a support shaft 215L, a third link 105Lc having one end fixed to the second arm rotation shaft 210L, and a fourth link 105Ld having one end rotatably connected to the other end of the third link 105Lc through a support shaft 216L. The other end of the second link 105Lb is rotatably connected to the other end of the fourth link 105Ld through the support shaft 211L.

Figure 7:
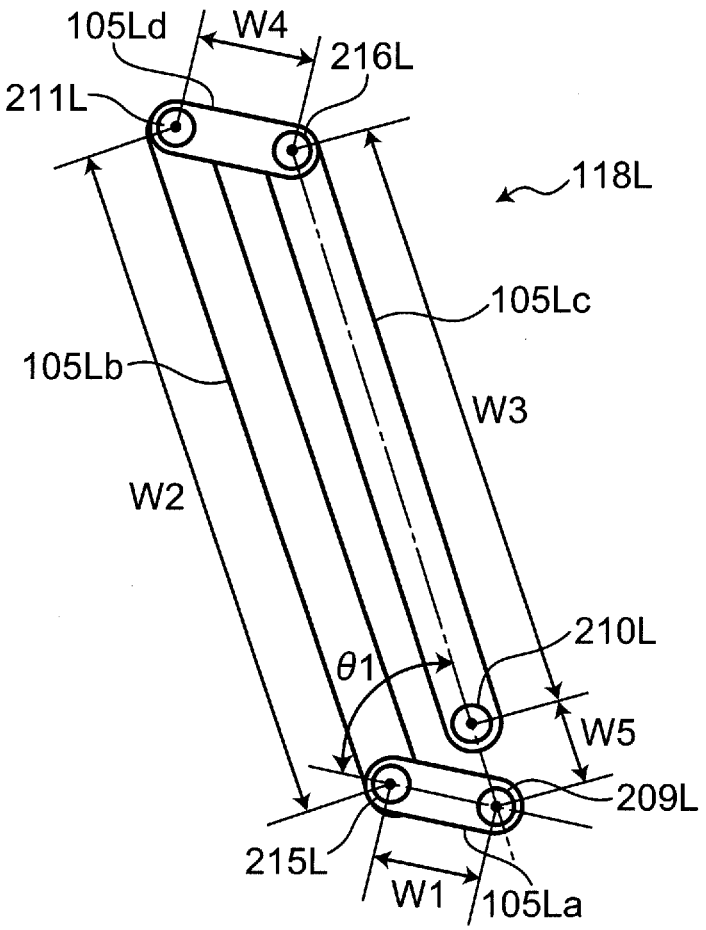
FIG. 7 is a view showing a first arm of the washing arm of the automatic head washing device in accordance with the first embodiment.

FIG. 7 is a view showing the first arm of the washing arm of the automatic head washing device in accordance with the first embodiment. FIG. 7 shows the five-joint link mechanism 118L of the first arm 105L. As shown in FIG. 7, the five-joint link mechanism 118L is configured of four linear links: the first link 105La, the second link 105Lb, the third link 105Lc, and the fourth link 105Ld.

In the five-joint link mechanism 118L, it is assumed that the link length of the first link 105La is W1, the link length of the second link 105Lb is W2, the link length of the third link 105Lc is W3, the link length of the fourth link 105Ld is W4, and the distance between the center of the first arm rotation shaft 209L and the center of the second arm rotation shaft 210L is W5. In the five-joint link mechanisms 118L in the first embodiment, the ratio of the link length W1 of the first link 105La to the link length W4 of the second link 105Ld is set to "W1:W4=1:1". The link length W1 of the first link 105La is the distance between the center of the first arm rotation shaft 209L and the center of the support shaft 215L, and the link length W4 of the fourth link 105Ld is the distance between the center of the support shaft 216L and the center of the support shaft 211L.

In the five-joint link mechanisms 118L in the first embodiment, the link length W3 of the third link 105Lc is set to be larger than the link length W1 of the first link 105La, and the link length W2 of the second link 105Lb is set to be larger than the link length W3 of the third link 105Lc. The link length W3 of the third link 105Lc is the distance between the center of the second arm rotation shaft 210L and the center of the support shaft 216L, and the link length W2 of the second link 105Lb is the distance between the center of the support shaft 215L and the center of the support shaft 211L.

In the five-joint link mechanisms 118L in the first embodiment, the ratio among the link length W1 of the first link 105La, the link length W2 of the second link 105Lb, the link length W3 of the third link 105Lc, and the link length W4 of the fourth link 105Ld is set to "W1:W2:W3:W4=1:4:3.5:1". A sum of the distance W5 and the link length W3 of the third link 105Lc (W5+W3) is equal to the link length W2 of the second link 105Lb.

In the five-joint link mechanisms 118L, the second link 105Lb and the third link 105Lc are disposed such that the third link 105Lc is farther from the head support 11 than the second link 105Lb. As shown in FIG. 7, when the third link 105Lc is disposed on a line connecting the first arm rotation shaft 209L to the second arm rotation shaft 210L, the five-joint link mechanism 118L is parallelogrammical.

In the first arm 105L having the five-joint link mechanisms 118L thus configured, the first arm rotation shaft 209L rotates to rotate the first links 105La, and the second arm rotation shaft 210L rotates to rotate the second links 105Lb. In the left washing arm 12L, the first links 105La and the second links 105Lb of the first arm 105L rotate, thereby moving the support shaft 211L with respect to the arm base 103L and moving the working body 115L with respect to the arm base 103L. The rotation of the first arm rotation shaft 209L and the second arm rotation shaft 210L is controlled by the control unit 400.

Figure 8:
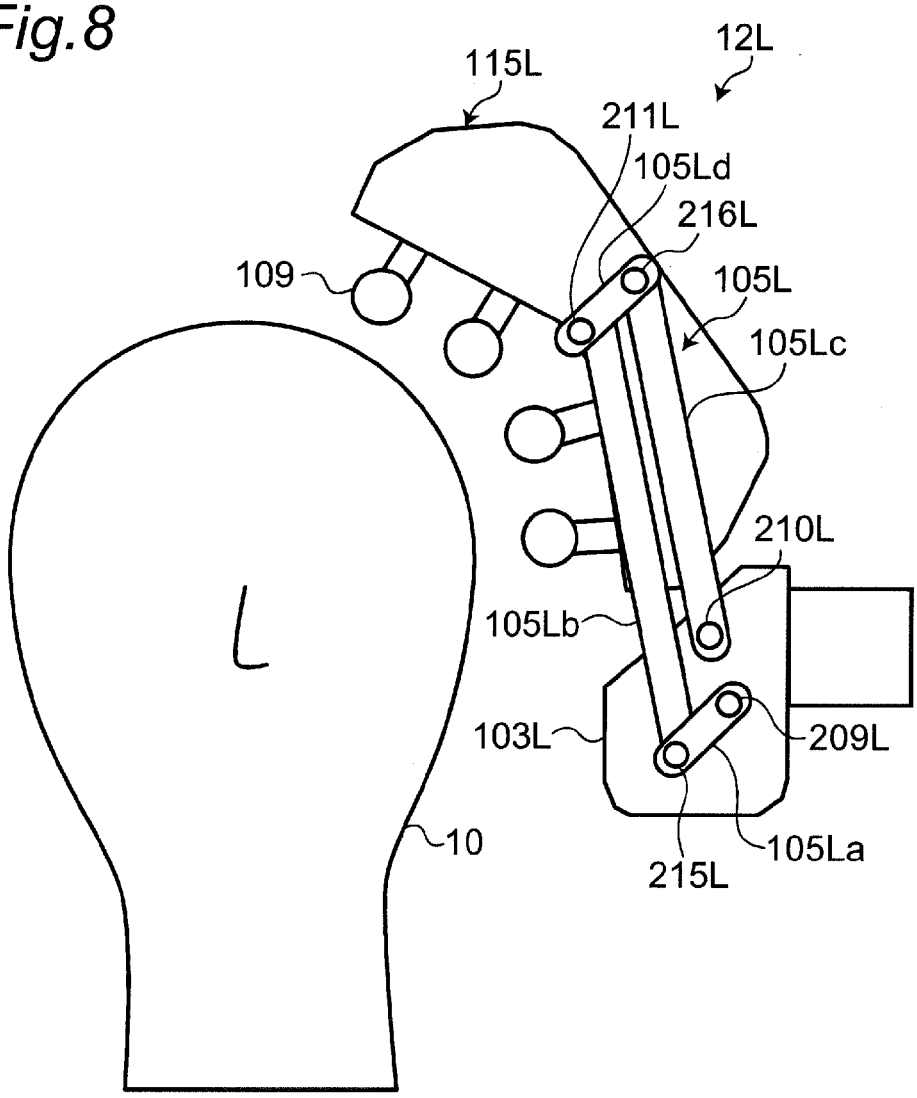
FIG. 8 is a view showing the washing arm of the automatic head washing device in accordance with the first embodiment in an initial state.

FIG. 8 is a view showing the washing arm of the automatic head washing device in accordance with the first embodiment in an initial state. As shown in FIG. 8, in washing the person's head 10, the washing arm 12L is first placed in the predetermined initial state where the person's head 10 supported by the head support 11 does not interfere with the working body 115L. In the washing arm 12L in the initial state, the control unit 400 controls the rotation of the first arm rotation shaft 209L and the second arm rotation shaft 210L to control the position of the working body 115L.

Figure 9:
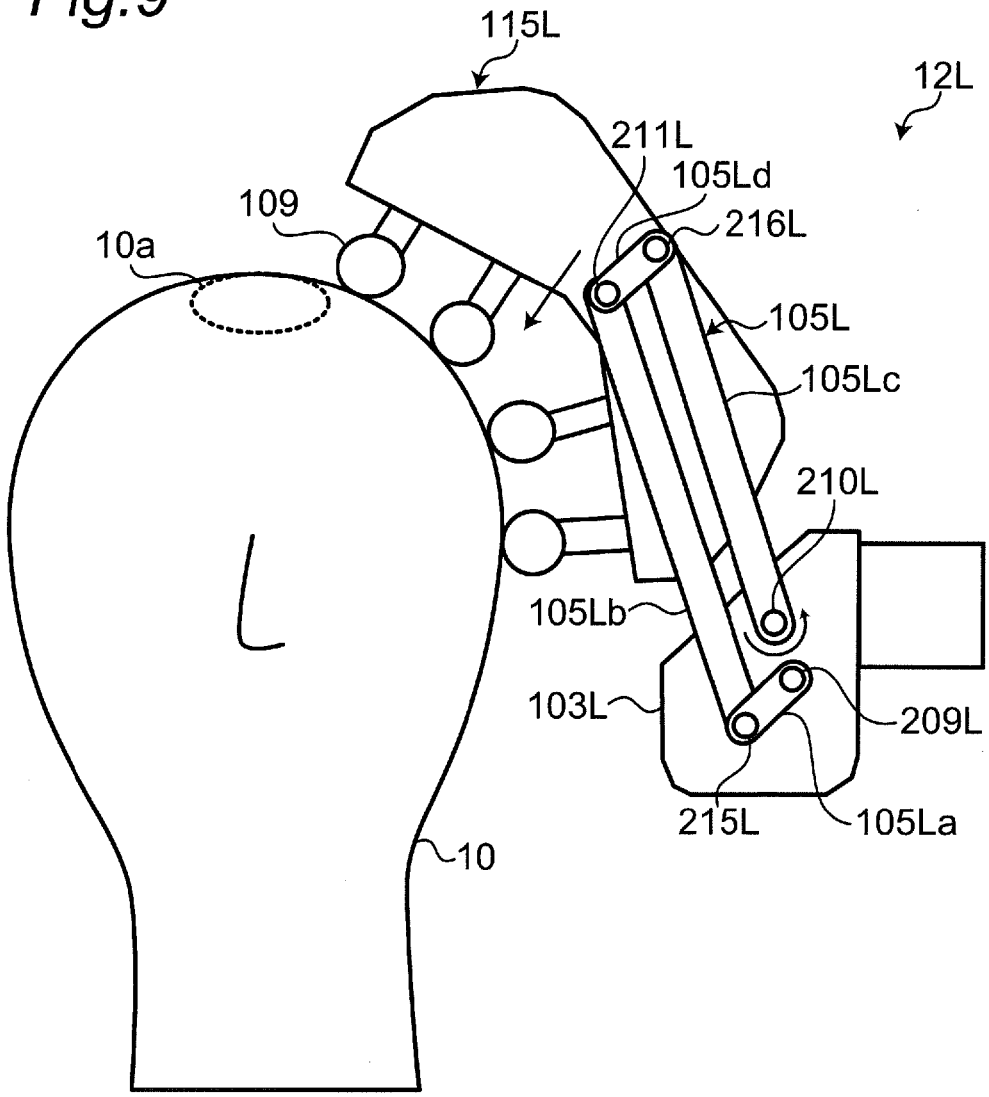
FIG. 9 is a view showing the washing arm of the automatic head washing device in accordance with the first embodiment in a pressing state.

FIG. 9 is a view showing the washing arm of the automatic head washing device in accordance with the first embodiment in a pressing state. When the person's head 10 supported by the head support 11 is washed, as shown in FIG. 9, the washing arm 12L is placed in the pressing state where the working body 115L (specifically, the contacts 109) presses the person's head 10 with a predetermined pressing force. In the state where the first arm rotation shaft 209L is fixed, by rotating the second arm rotation shaft 210L counterclockwise in FIG. 9 to move the working body 115 toward the head support 11, the working body 115L of the washing arm 12L presses the person's head 10.

When the second arm rotation shaft 210L is rotated in the state where the first arm rotation shaft 209L is fixed, the first links 105La do not move, and the second links 105Lb rotate about the support shaft 215L as a connection with the first links 105La counterclockwise in FIG. 9. As a result, a force toward the head support 11 is applied to the support shaft 211L as a connection with the fourth links 105Ld. Thereby, the working body 115L supported by the support shaft 211L moves toward the head support 11 to press the person's head 10.

As described above, in the washing arm 12L, when the second arm rotation shaft 210L is rotated in the state where the first arm rotation shaft 209L is fixed, the second links 105Lb rotate about the support shaft 215L, and the support shaft 215L connected to the second links 105Lb moves toward the head support 11. As a result, the working body 115L contacts the person's head 10 supported by the head support 11.

Since the working body 115L is rotatably supported by the support shaft 211L, when the working body 115L is brought into contact with the person's head 10 (specifically, when the contacts 109 are brought into contact with the person's head 10), the working body 115L rotates about the support shaft 211L, causing the contacts 109 to contact the person's head 10.

The working body 115L is supported by the support shaft 211L on the side of the head support 11. Thus, a supporting point of the working body 115L is located near the person's head 10 supported by the head support 11, thereby effectively bringing the working body 115L into contact with the person's head 10.

Even when the washing arm 12L is shifted from the initial state to the pressing state as shown in FIG. 9, depending on the shape or size of the person's head 10, the working body 115L may not contact with a vertex 10*a* of the person's head 10. However, in the washing arm 12L in this embodiment, the working body 115L can extend and contract with respect to the arm base 103L so as to be in contact with the whole of the person's head 10.

The working body 115L is extended and contracted with respect to the arm base 103L on the basis of the position of the person's head 10, which is detected by a position detector such as a camera detecting the position of the person's head 10. The extending operation of the washing arm 12L is performed, for example, when the working body 115L does not reach the vertex 10*a* of the person's head 10.

Figure 10:
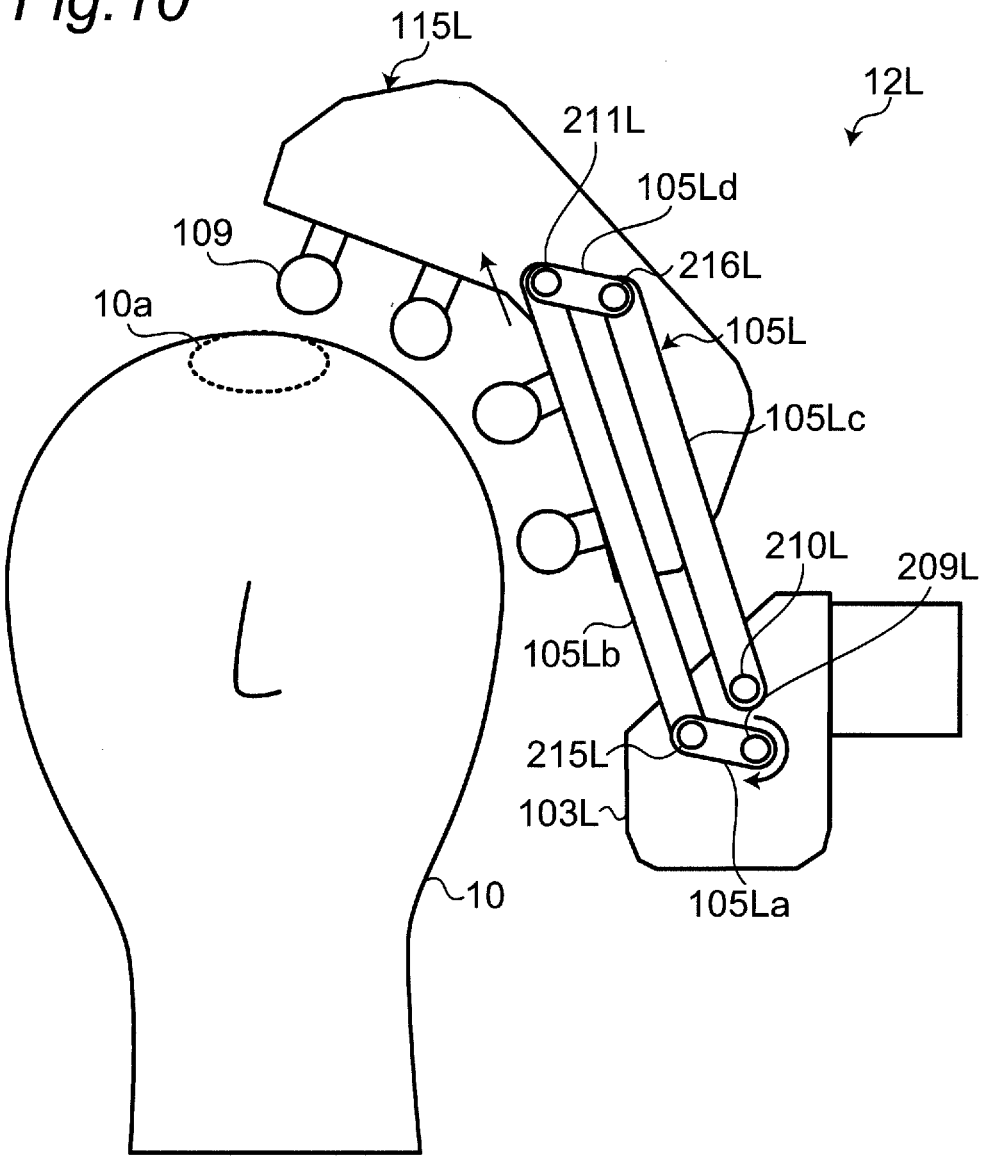
FIG. 10 is a view showing an extending operation of the washing arm of the automatic head washing device in accordance with the first embodiment.

FIG. 10 is a view showing the extending operation of the washing arm of the automatic head washing device in accordance with the first embodiment. In the case where the working body 115L does not contact the person's head 10 even when the washing arm 12L is shifted from the initial state to the pressing state, as shown in FIG. 10, the washing arm 12L is extended to separate the working body 115L from the arm base 103.

By rotating the first arm rotation shaft 209L clockwise in FIG. 10 in the state where the second arm rotation shaft 210L is fixed, the working body 115L moves toward the vertex 10*a* of the person's head 10.

When the first arm rotation shaft 209L is rotated in the state where the second arm rotation shaft 210L is fixed, the third links 105Lc do not move, and the fourth links 105Ld rotate about the support shaft 216L as a connection with the third links 105Lc counterclockwise in FIG. 10. As a result, a force toward the vertex 10*a* of the person's head 10 is applied to the support shaft 211L as a connection with the second links 105Lb. Thereby, the working body 115L supported by the support shaft 211L moves toward the vertex 10*a* of the person's head 10.

As shown in FIG. 10, when the first arm rotation shaft 209L is rotated in the state where the second arm rotation shaft 210L is fixed and the working body 115L is moved toward the vertex 10*a* of the person's head 10, the working body 115L may be away from the person's head 10. For this reason, in the first embodiment, the working body 115 is moved toward the head support 11 to bring the working body 115 into contact with the person's head 10.

Figure 11:
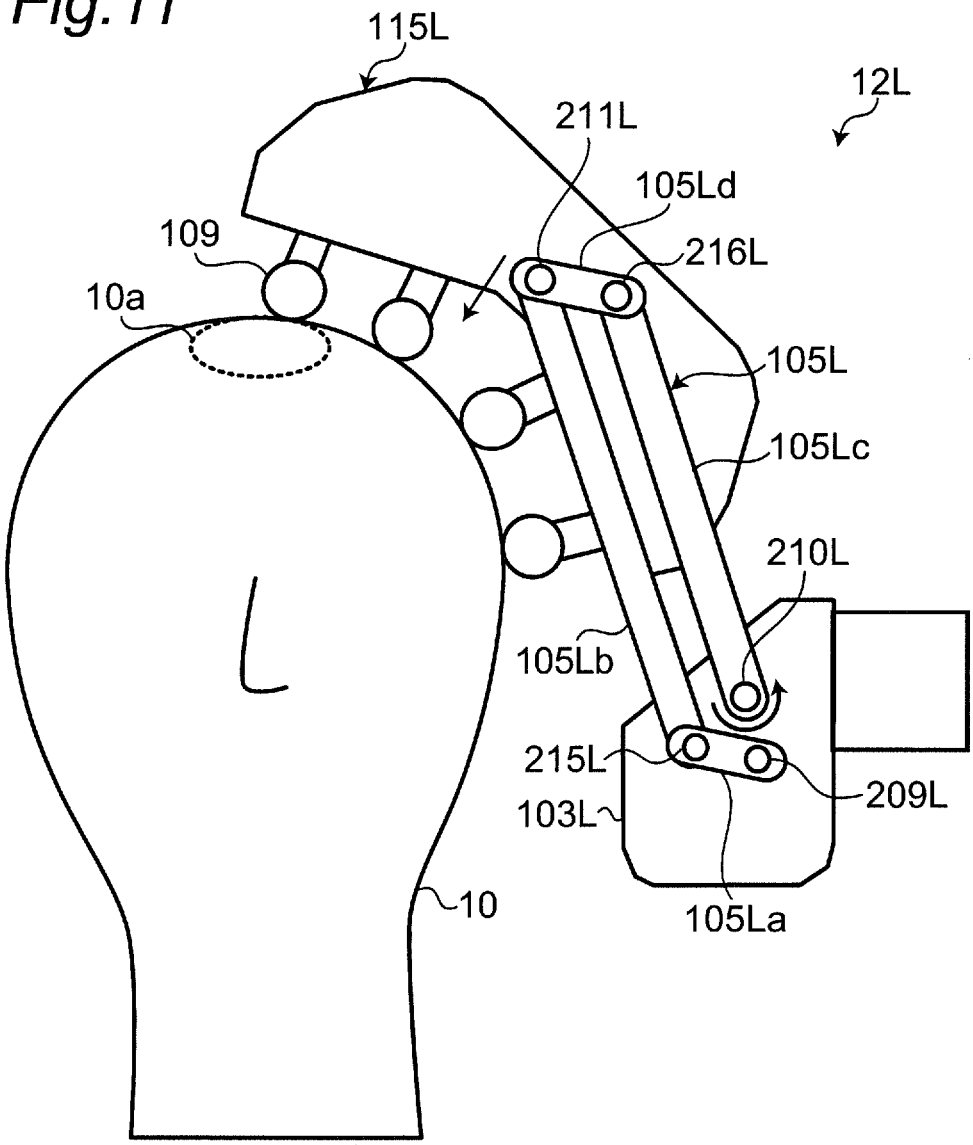
FIG. 11 is a view showing the extending operation of the washing arm of the automatic head washing device in accordance with the first embodiment.

FIG. 11 is a view showing the extending operation of the washing arm of the automatic head washing device in accordance with the first embodiment. As shown in FIG. 10, the working body 115L of the washing arm 12L is moved toward the vertex. 10*a* of the person's head 10 and subsequently the second arm rotation shaft 210L is rotated counterclockwise in FIG. 11 in the state where the first arm rotation shaft 209L is fixed, and the working body 115 is moved toward the head support 11 to cause the working body 115L to press the person's head 10.

When the second arm rotation shaft 210L is rotated in the state where the first arm rotation shaft 209L is fixed, the first links 105La do not move, and the second links 105Lb rotate about the support shaft 215L counterclockwise in FIG. 11. As a result, a force toward the head support 11 is applied to the support shaft 211L. Thereby, the working body 115L supported by the support shaft 211L moves toward the head support 11 and presses the person's head 10 with a predetermined pressing force.

As described above, in the washing arm 12L, by controlling the rotation of the first arm rotation shaft 209L and the second arm rotation shaft 210L, the working body 115L can be extended with respect to the arm base 103L.

When the working body 115L is contracted with respect to the arm base 103L in the washing arm 12, as shown in FIG. 9, the second arm rotation shaft 210L is fixed in the state where the working body 115L of the washing arm 12L is in contact with the person's head 10 and subsequently the first arm rotation shaft 209L is rotated counterclockwise in FIG. 9. As a result, the working body 115L moves away from the vertex 10*a* of the person's head 10. Next, by rotating the second arm rotation shaft 210L clockwise in FIG. 9 in the state where the first arm rotation shaft 209L is fixed, the working body 115L presses the person's head 10 with a predetermined pressing force.

According to the operation of extending and contracting the washing arm 12L, the first arm rotation shaft 209L is rotated in the state where the second arm rotation shaft 210L is fixed and subsequently the second arm rotation shaft 210L is rotated in the state where the first arm rotation shaft 209L is fixed. However, the second arm rotation shaft 210L may be rotated in the state where the first arm rotation shaft 209L is fixed and subsequently the first arm rotation shaft 209L may be rotated in the state where the second arm rotation shaft 210L is fixed, in order to extend and contract the working body 115 with respect to the arm base 103L. In the washing arm 12L, by rotating both of the first arm rotation shaft 209L and the second arm rotation shaft 210L, the working body 115L may be extended and contracted with respect to the arm base 103L.

As described above, by rotating the first arm rotation shaft 209L and the second arm rotation shaft 210L, the washing arm 12L can be extended and contracted with respect to the arm base 103L. Thus, even when the person's head 10 changes in shape and size with change in the washed person, the person's head 10 can be reliably washed according to the shape and size of the person's head 10.

In the five-joint link mechanisms 118L in the first embodiment, the link length W1 of the first link 105La is set to be equal to the link length W4 of the fourth link 105Ld. However, depending on the design of the five-joint link mechanism, the link length W1 of the first link 105La may be made different from the link length W4 of the fourth link 105Ld.

In the five-joint link mechanisms 118L, the sum of the distance W5 between the center of the first arm rotation shaft 209L and the center of the second arm rotation shaft 210L, and the link length W3 of the third link 105Lc (W5+W3) is equal to the link length W2 of the second link 105Lb. However, depending on the design of the five-joint link mechanism, the sum of the distance W5 between the center of the first arm rotation shaft 209L and the center of the second arm rotation shaft 210L, and the link length W3 of the third link 105Lc (W5+W3) may be made different from the link length W2 of the second link 105Lb.

In the five-joint link mechanisms 118L in this embodiment, the position of the support shaft 211L can be changed by controlling the rotation of the first arm rotation shaft 209L and the second arm rotation shaft 210L. However, when the second links 105Lb and the fourth links 105Ld, which are not fixed to the first arm rotation shaft 209L and the second arm rotation shaft 210L, are disposed in a line, and the support shaft 215L, the support shaft 211L, and the support shaft 216L are disposed in a line, the links lack in balance, possibly causing a failure of the operation of the five-joint link mechanisms 118L.

To prevent this, in the automatic head washing device 100 in this embodiment, the control unit 400 controls the rotation of the first arm rotation shaft 209L and the second arm rotation shaft 210L so as not to dispose the second links 105Lb and the fourth links 105Ld in a line, and not to dispose the support shaft 215L, the support shaft 211L, and the support shaft 216L in a line.

Specifically, the control unit 400 controls the operation of the motor 221L and the motor 228L so as to confine the rotation of the first arm rotation shaft 209L and the second arm rotation shaft 210L within a range of an angle θ1 between the first link 105La and the third link 105Lc of 90±60 degrees. That is, the control unit 400 controls the operation of the motor 221L and the motor 228L so as to confine the angle θ1 between the first link 105La and the third link 105Lc (refer to FIG. 7) within the range of 90±60 degrees.

By confining the angle θ1 between the first link 105La and the third link 105Lc within the range of 90±60 degrees in this manner, displacement of the working body 115L supported by the support shaft 211L with respect to the rotation of the first arm rotation shaft 209L and the second arm rotation shaft 210L can be increased, achieving the movement of the working body 115L in a wide range.

In the first embodiment, the control unit 400 controls the motor 221L and the motor 228L to confine the angle θ1 between the first link 105La and the third link 105Lc within the range of 90±60 degrees, but the angle θ1 between the first link 105La and the third link 105Lc may be confined within the range of 90±60 degrees by use of other confining means such as a stopper or spring.

The right washing unit 12R has the same configuration as the left washing unit 12L. The right washing unit 12R has a working body 115R washing the person's head 10, a first arm 105R rotatably supporting the working body 115R, an arm base 103R to which the first arm 105R is attached, a support shaft 104R fixed to the arm base 103R, and the pipe 111R fixed to the arm base 103R.

As shown in FIG. 2, in the washing arm 12R, the support shaft 104R is rotatably coupled to the support column 102R, and can rotate about the support shaft 104R. That is, in the washing arm 12R, the support shaft 104R is rotatably attached to the bowl 101, and can rotate about the support shaft 104R.

A motor 201R is disposed in the support column 102R. A rotation output of the motor 201R is transmitted to the support shaft 104R via a gear 203R attached to a motor rotation output shaft 202R and a gear 204R attached to the support shaft 104R. The arm base 103R fixed to the support shaft 104R is driven by the rotation output transmitted from the motor 201R to be rotatable about the support shaft 104R. Driving of the motor 201R is controlled by the control unit 400.

The pipe 111R has the same configuration as the pipe 111L. The pipe 111R has the plurality of nozzles 110 ejecting at least one of water, hot water, washing agent, and conditioner through the piping 219, is attached to the arm base 103R, and can rotate about the support shaft 104R together with the arm base 103R.

The working body 115R has the same configuration as the working body 115L. The working body 115R includes a second arm 106R rotatably supported by the first arm 105R through a support shaft 211R, third arms 107R and 108R rotatably supported by the second arm 106R through support shafts 213R and 214R, respectively, and a housing 116R surrounding the second arm 106R and the third arms 107R and 108R.

An elastic body such as a spring is provided between the second arm 106R and the first arm 105R to hold the second arm 106R at a predetermined position with respect to the first arm 105R. Elastic bodies such as springs are provided between the third arm 107R and the second arm 106R and between the third arm 108R and the second arm 106R to hold the third arms 107R and 108R at respective predetermined positions with respect to the second arm 106R.

The plurality of contacts 109 that make contact with the person's head 10 supported by the head support 11 are attached to each of the third arms 107R and 108R. The contact units each having the plurality of contacts 109 at its front ends are rotatably supported by each of the third arms 107R and 108R, thereby swingably attaching the plurality of contacts 109 to each of the third arms 107R and 108R.

The first arm 105R has the same configuration as the first arm 105L. The first arm 105R includes a first arm rotation shaft 209R and a second arm rotation shaft 210R that are independently rotated, and the first arm rotation shaft 209R and the second arm rotation shaft 210R each are rotatably held by the arm base 103R. The rotation of the first arm rotation shaft 209R and the second arm rotation shaft 210R is controlled by the control unit 400.

Figure 12:
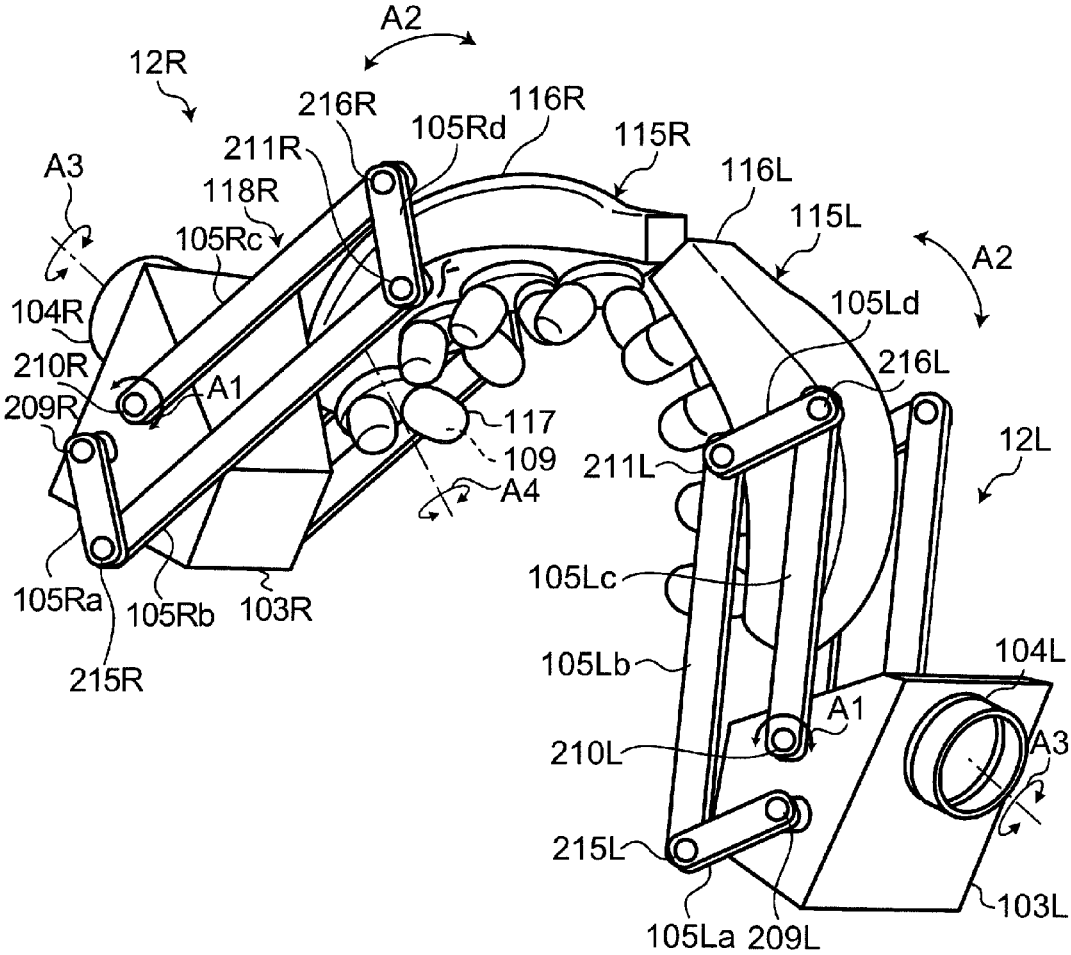
FIG. 12 is a view showing the operation of the washing arms of the automatic head washing device in accordance with the first embodiment.

As shown in FIG. 12 described later, the first arm 105R includes two five-joint link mechanisms 118R and the support shaft 211R. The support shaft 211R couples the two five-joint link mechanisms 118R to each other and rotatably supports the working body 115R.

The five-joint link mechanisms 118R each include a first link 105Ra having one end fixed to the first arm rotation shaft 209R, a second link 105Rb having one end rotatably connected to the other end of the first link 105Ra through a support shaft 215R, a third link 105Rc having one end fixed to the second arm rotation shaft 210R, and a fourth link 105Rd having one end rotatably connected to the other end of the third link 105Rc through a support shaft 216R. In the five-joint link mechanisms 111R in this embodiment, the other end of the second link 105Rb is rotatably connected to the other end of the fourth link 105Rd through the support shaft 211R.

In the first arm 105R, the first arm rotation shaft 209R rotates to rotate the first links 105Ra, and the second arm rotation shaft 210R rotates to rotate the second links 105Rb. In the washing unit 12R, the first links 105Ra and the second links 105Rb of the first arm 105R rotate, thereby moving the support shaft 211R with respect to the arm base 103R and moving the working body 115R with respect to the arm base 103R.

The operation of the washing arms 12L and 12R will be described below with reference to FIG. 12.

FIG. 12 is a view showing the operation of the washing arms of the automatic head washing device in accordance with the first embodiment. In FIG. 12, the contacts 109 are covered with a cover 117. The washing arms 12L and 12R are controlled by the control unit 400 to perform a pressing operation, an extending and contracting operation, a swinging operation, and a rubbing operation.

The pressing operation of the washing arms 12L and 12R refers to the operation of rotating the second arm rotation shafts 210L and 210R of the first arms 105L and 105R in the directions of an arrow A1 in FIG. 12 to move the working bodies 115L and 115R to be closer to the person's head 10 supported by the head support 11 (pressing direction) or to be away from the person's head 10 (releasing direction).

The extending and contracting operation of the washing arms 12L and 12R refers to the operation of rotating the first arm rotation shafts 209L and 209R and the second arm rotation shafts 210L and 210R of the first arms 105L and 105R to move the working bodies 115L and 105R to be away from the arm bases 103L and 103R, respectively, in the extending direction or to be closer to the arm bases 103L and 103R, respectively, in the contracting direction, the extending and contracting directions being directions represented by an arrow A2 in FIG. 12.

The swinging operation of the washing arms 12L and 12R refers to the operation of rotating the support shafts 104L and 104R of the first arms 105L and 105R to rotate the washing arms 12L and 12R about the support shafts 104L and 104R, respectively, in the directions of an arrow A3 in FIG. 12, thereby moving the working bodies 115L and 115 in the forward and rearward direction of the person's head 10.

The rubbing operation of the washing arms 12L and 12R refers to the operation of rotating the motor 301L disposed in the housings 116L and 116R of the working bodies 115L and 115R to rotate the contacts 109 of the working body 115L in directions of an arrow A4 in FIG. 12, thereby causing the contacts 109 to swing.

In the automatic head washing device 100, the pressing operation, the extending and contracting operation, the swinging operation, and the rubbing operation of the washing arms 12L and 12R are performed independently or in cooperation under control of the control unit 400 to wash the person's head 10. In washing the person's head 10, the control unit 400 controls the operations of the water supplying unit, the washing agent supplying unit, and the conditioner supplying unit.

The automatic head washing device 100 in this embodiment is a device automatically washing the person's head 10, and can be also used as an automatic head care device automatically massaging the person's head 10 with the contacts 109 while water, shampoo, or so on is not ejected from the nozzles 110.

Figure 13:
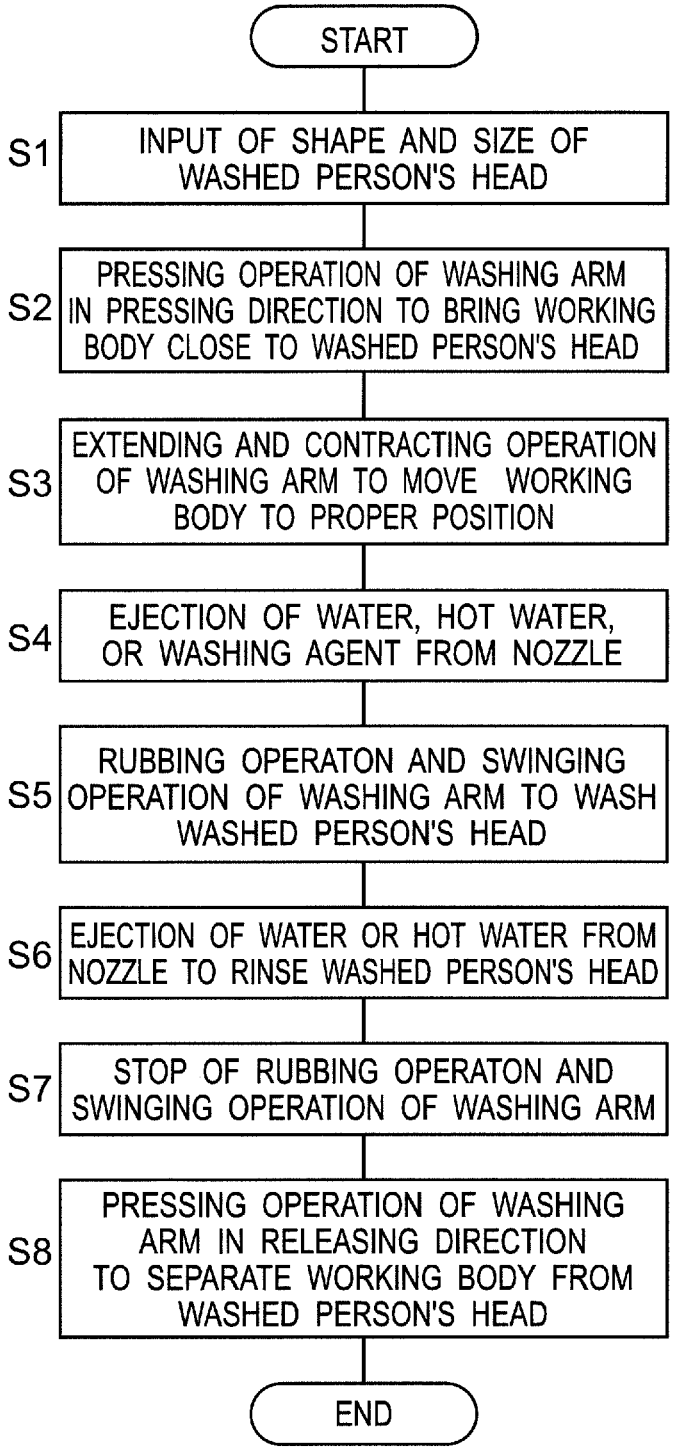
FIG. 13 is a flow chart showing a washing method of the automatic head washing device in accordance with the first embodiment.

FIG. 13 is a flow chart showing a washing method of the automatic head washing device in accordance with the first embodiment. As shown in FIG. 13, when the automatic head washing device 100 washes the person's head 10, first, the washing arms 12L and 12R are located in the initial state, and the head 10 of the washed person is inserted into the bowl 101 and placed on the head support 11. Then, the operator of the automatic head washing device 100 or the washed person inputs the shape and size of the head 10 of the washed person (Step S1). The automatic head washing device 100 is provided with an input device such as a keyboard inputting the shape and size of the head 10 such that the information from the input device is inputted to the control unit 400.

Then, the washing arms 12L and 12R are pressed in the pressing direction, bringing the working bodies 115L and 115R close to and into contact with the head 10 of the washed person (Step S2). Specifically, in the state where the first arm rotation shafts 209L and 209R of the washing arms 12L and 12R are fixed, the second arm rotation shafts 210L and 210R are rotated to move the working bodies 115L and 115R toward the head support 11, thereby bringing the working bodies 115L and 115R into contact with the head 10 of the washed person.

Next, the washing arms 12L and 12R are extended or contracted based on the shape and size of the head 10, which are inputted in Step S1, to move the working bodies 115L and 115R to respective proper positions (Step S3). The extending or contracting operation of the washing arms 12L and 12R is performed by controlling the rotation of the first arm rotation shafts 209L and 209R and the second arm rotation shafts 210L and 210R.

The extending and contracting operation of the washing arms 12L and 12R is performed by rotating the first arm rotation shaft 209L and subsequently rotating the second arm rotation shaft 210L, or by rotating the second arm rotation shaft 210L and subsequently rotating the first arm rotation shaft 209L. The first arm rotation shaft 209L and the second arm rotation shaft 210L may be simultaneously rotated to perform the extending and contracting operation.

In the automatic head washing device 100, the first arms 105L and 105R include respective pressure sensors detecting the pressing force of the working bodies 115L and 115R onto the person's head 10, respectively. By simultaneously rotating the first arm rotation shaft 209L and the second arm rotation shaft 210L based on the pressing forces detected by the pressure sensors, the washing arms 12L and 12R can be extended or contracted with a predetermined pressing force.

After the working bodies 115L and 115R are moved to the proper positions with respect to the head 10 of the washed person in Step S3, water, hot water, or washing agent is ejected from the nozzles 110 to the head 10 of the washed person (Step S4).

Then, the rubbing operation and the swinging operation of the washing arms 12L and 12R are performed to wash the head 10 of the washed person (Step S5). The head 10 of the washed person is washed by rotating and swinging the contacts 109 provided on the working body 115L of the washing arms 12L and 12R. The entire head 10 of the washed person is washed by moving the washing arms 12L and 12R in the forward and rearward direction of the head 10 of the washed person.

The swinging operation of the washing arms 12L and 12R is not limited to this, and may be performed by moving the washing arm 12L and the washing arm 12R in the forward and rearward direction of the head 10 such that the arms are aligned in the forward and rearward direction of the head 10 of the washed person. Alternatively, the swinging operation of the washing arms 12L and 12R can be performed by repeating the operation of moving the washing arm 12L from the front side to the rear side of the head 10 and moving the washing arm 12R from the rear side to the front side of the head 10, and the operation of moving the washing arm 12L from the rear side to the front side of the head 10 and moving the washing arm 12R from the front side to the rear side of the head 10.

After the rubbing operation and the swinging operation of the washing arms 12L and 12R are performed to wash the head 10 of the washed person in Step S5, water or hot water is ejected from the nozzles 110 to the head 10 of the washed person to rinse the head 10 of the washed person (Step S6). Following the rinsing of the head 10 of the washed person in Step S6, the rubbing operation and the swinging operation of washing arms 12L and 12R are stopped (Step S7).

Then, the washing arms 12L and 12R are pressed in the releasing direction to separate the working bodies 115L and 115R from the head 10 of the washed person (Step S8). In the state where the first arm rotation shafts 209L and 209R of the washing arms 12L and 12R are fixed, the second arm rotation shafts 210L and 210R are rotated so as to move the working bodies 115L and 115R away from the head support 11, thereby separating the working bodies 115L and 115R from the head 10 of the washed person. The washing arms 12L and 12R are returned to the initial state to finish washing of the head 10 of the washed person. Conditioner is ejected from the nozzles 110 to the head 10 of the washed person as needed.

As described above, the automatic head washing device 100 in accordance with the first embodiment includes the first arm rotation shafts 209L and 209R and the second arm rotation shafts 210L and 210R, which are independently rotated, the first links 105La and 105Ra fixed to the first arm rotation shafts 209L and 210R, respectively, the second links 105Lb and 105Rb rotatably connected to the first links 105La and 105Ra, respectively, the third links 105Lc and 105Rc fixed to the second arm rotation shafts 210L and 210R, respectively, the fourth links 105Ld and 105Rd rotatably connected to the third links 105Lc and 105Rc, respectively, the support shafts 211L and 211R rotatably connecting the second links 105Lb and 105Rb to the fourth links 105Ld and 105Rd, respectively, the working bodies 115L and 115R rotatably supported by the support shafts 211L and 211R, respectively, and the control unit 400 controlling the rotation of the first arm rotation shafts 209L and 209R and the second arm rotation shafts 210L and 210R. With such a configuration, even when the person's head 10 changes in shape and size with change in the washed person, the person's head 10 can be reliably washed according to the shape of the person's head 10.

The control unit 400 can control the rotation of the first arm rotation shafts 209L and 209R and the second arm rotation shafts 210L and 210R such that the working bodies 115L and 115R of the washing arms 12L and 12R can be extended and contracted with respect to the arm bases 103L and 103R, respectively. With this configuration, the person's head 10 can be washed more reliably.

The automatic head washing device 100 may be provided with a current detection unit such as a current sensor detecting a current value of the motor 228L that rotates the second arm rotation shafts 210L and 210R. The control unit 400 can calculate a force applied to the motor 228L on the basis of a change in the current value of the motor 228, which is detected by the current detection unit.

For example, when the person's head 10 supported by the head support 11 moves in the state where the working bodies 115L and 115R are in contact with the person's head 10, the force to raise the working bodies 115L and 115R according to the motion of the person's head 10 is transmitted to the motor 228L through the fourth link 105Ld, the third link 105Lc, the second arm rotation shaft 210L, and the second conversion mechanism. This is due to that the first conversion mechanism 227L is irreversible. Accordingly, the force applied to the motor 228L can be calculated based on the change in the current value of the motor 228 by use of the first conversion mechanism 227L to easily measure the force to raise the working bodies 115L and 115R.

Assuming that the washed person attempts to move the head 10 from the head support 11 to pull the head out of the bowl 101 while the automatic head washing device 100 is washing the person's head 10. In this case, since the force to raise the working bodies 115L and 115R according to the motion of the person's head 10 can be absorbed by the reversible second conversion mechanism, the head 10 can be pulled out of the automatic head washing device 100.

Second Embodiment

Next, an automatic head washing device in accordance with a second embodiment of the present invention will be described. Only differences between the automatic head washing device in accordance with the second embodiment of the present invention and the automatic head washing device 100 in accordance with the first embodiment will be described. The same constituents as those in the automatic head washing device 100 in accordance with the first embodiment are not described.

Figure 14A:
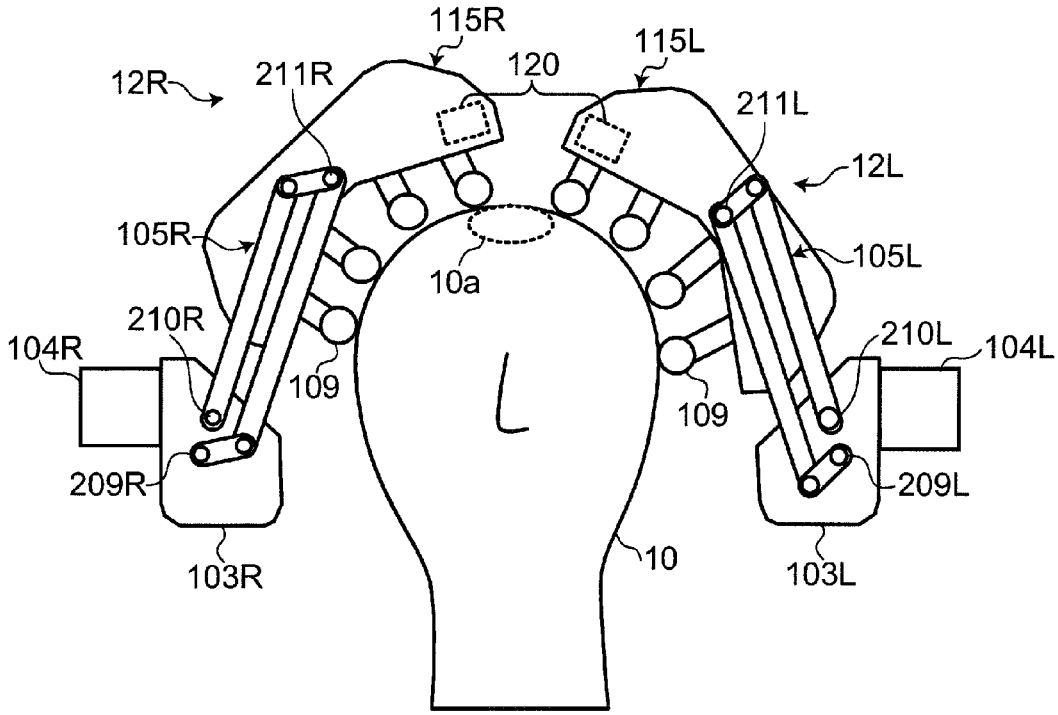
FIG. 14A is a view showing the operation of washing arms of an automatic head washing device in accordance with a second embodiment of the present invention.
Figure 14B:
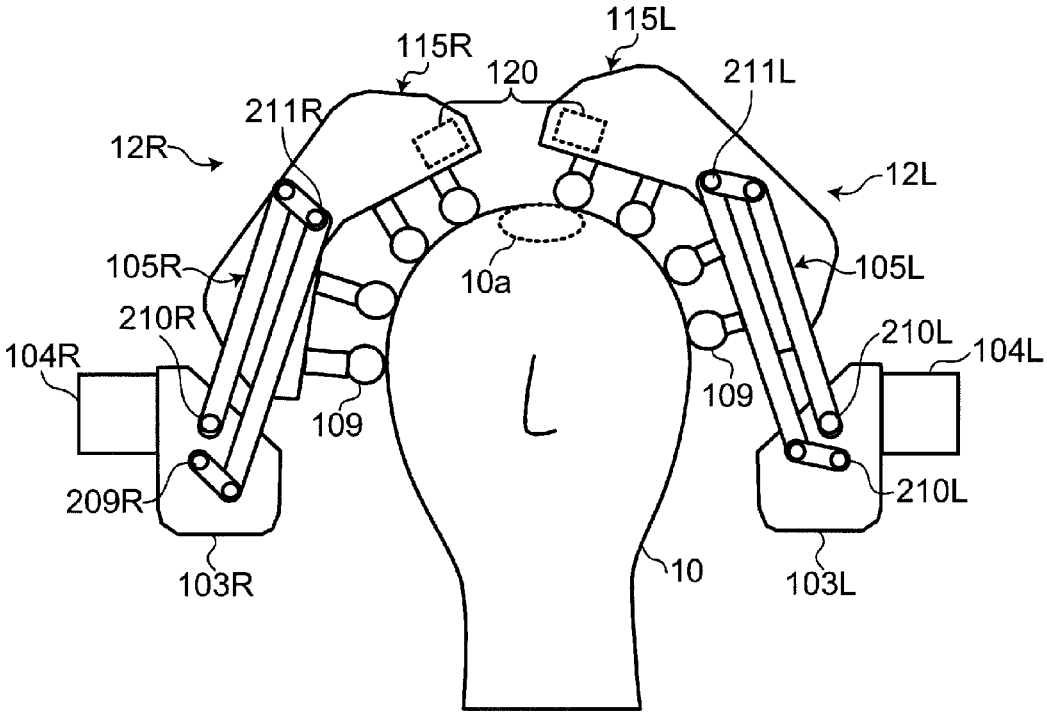
FIG. 14B is a view showing the operation of the washing arms of the automatic head washing device in accordance with the second embodiment.

FIG. 14A and FIG. 14B are is views showing the operation of washing arms of the automatic head washing device in accordance with the second embodiment of the present invention.

As shown in FIG. 14A and FIG. 14B, the automatic head washing device in accordance with the second embodiment includes a distance sensor 120 detecting a distance between the working bodies 115L and 115R in each of the working bodies 115L and 115R of the washing arms 12L and 12R. In the second embodiment, the control unit 400 controls the operation of the washing arms 12L and 12R on the basis of the distance between the working bodies 115L and 115R, which is detected by the distance sensor 120, the head 10 of the washed person can be washed while preventing the working bodies 115L and 115R from interfering with each other.

Third Embodiment

Next, an automatic head washing device in accordance with a third embodiment of the present invention will be described. Only differences between the automatic head washing device in accordance with the third embodiment of the present invention and the automatic head washing device 100 in accordance with the first embodiment will be described. The same constituents as those in the automatic head washing device 100 in accordance with the first embodiment are not described.

Figure 15:
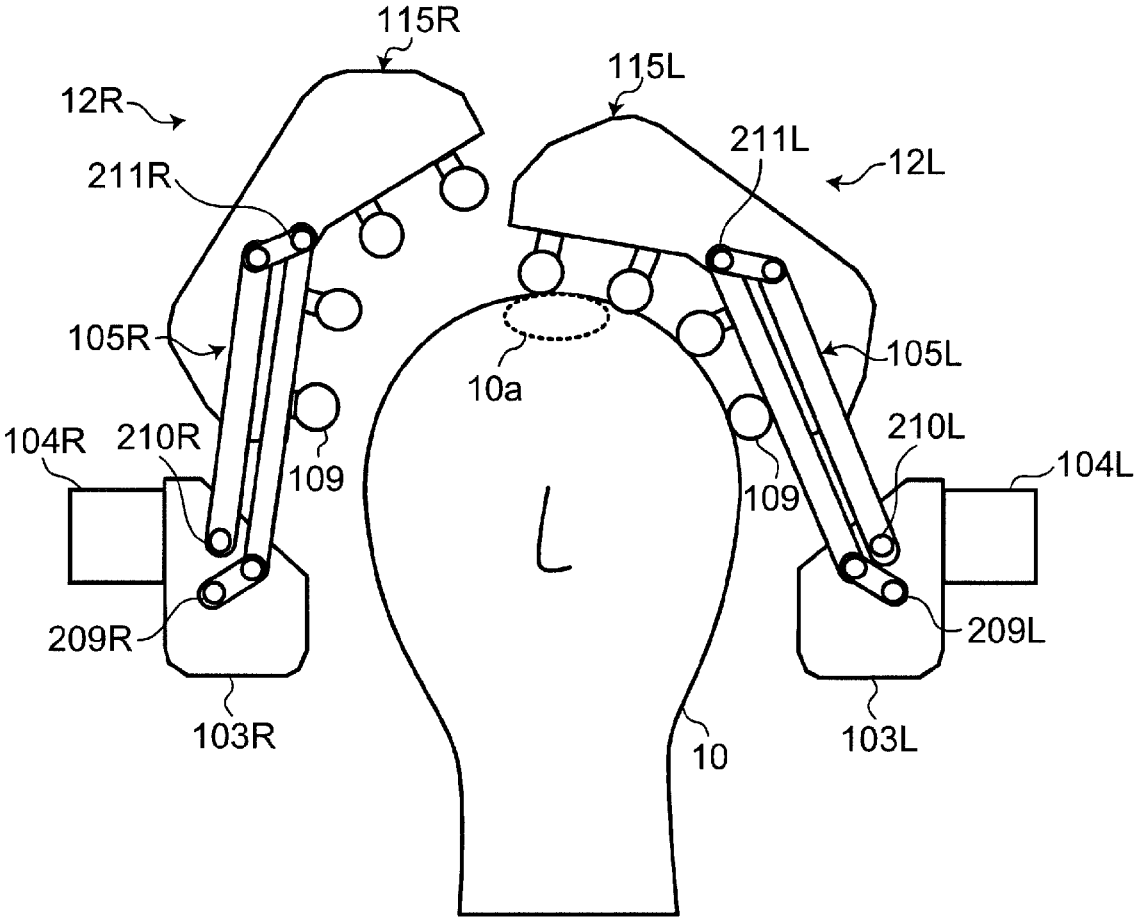
FIG. 15 is a view showing the operation of washing arms of an automatic head washing device in accordance with a third embodiment of the present invention.

FIG. 15 is a view showing the operation of washing arms of the automatic head washing device in accordance with the third embodiment of the present invention. The automatic head washing device in accordance with the third embodiment has the same configuration as the automatic head washing device 100.

In the automatic head washing device in accordance with the third embodiment, in washing the vertex 10*a* of the head 10 of the washed person, the control unit 400 controls the washing arms 12L and 12R such that, in the state where one washing arm 12R is separated from the head 10 as shown in FIG. 15, the working body 115L of the other washing arm 12L is extended with respect to the arm base 103L while keeping the contacts 109 in contact with the head 10.

Through such control, with the working body 115L of the other washing arm 12L being extended with respect to the arm base 103L, the rubbing operation and the swinging operation of the washing arm 12L are performed to wash the head 10 of the washed person. This can reliably wash the vertex 10*a* of the head 10 of the washed person.

In the description of the automatic head washing device in accordance with the third embodiment, the rubbing operation and the swinging operation are performed by extending the other washing arm 12L in the state where the working body 115R of the one washing arm 12R is separated from the head 10. However, the rubbing operation and the swinging operation may be performed by extending the other washing arm 12L in the state where the working body 115R of the one washing arm 12R is in contact with the head 10 to perform the rubbing operation and the swinging operation.

A reason for which such control is effective will be described. For example, supposing that the swinging operation of the washing arms 12L and 12R is performed by repeating the operation of moving the washing arm 12L from the front side to the rear side of the head 10 and moving the washing arm 12R from the rear side to the front side of the head 10 and the operation of moving the washing arm 12L from the rear side to the front side of the head 10 and moving the washing arm 12R from the front side to the rear side of the head 10, in the state where the washing arm 12L is extended. In this case, when the washing arms 12L and 12R are aligned in the forward and rearward direction of the head 10 of the washed person, both of the washing arms 12L and 12R may interfere with each other. Accordingly, by controlling to extend or contract only one of the washing arms 12L and 12R, for example, in the vicinity of the vertex 10*a* of the head 10 of the washed person, the head 10 of the washed person can be washed while preventing interference between the washing arms 12L and 12R.

The operation of the washing arms 12L and 12R can be controlled to wash the head 10 of the washed person so as to allow the washing arms 12L and 12R to perform the rubbing operation and the swinging operation while causing the arms 12L and 12R to be extended or contracted. In this manner, when both of the washing arms 12L and 12R perform the swinging operation while being aligned in the forward and rearward direction of the head 10 of the washed person, it is preferable to keep the distance between the working bodies 115L and 115R of the washing arms 12L and 12R uniform.

Further, the operation of the washing arms 12L and 12R can be controlled to wash the head 10 of the washed person so as to allow the washing arms 12L and 12R to perform the rubbing operation and the swinging operation while causing one of the washing arms 12L and 12R to be extended or contracted.

Fourth Embodiment

Next, an automatic head washing device in accordance with a fourth embodiment of the present invention will be described. Only differences between the automatic head washing device in accordance with the fourth embodiment of the present invention and the automatic head washing device 100 in accordance with the first embodiment will be described. The same constituents as those in the automatic head washing device 100 in accordance with the first embodiment are not described.

Figure 16:
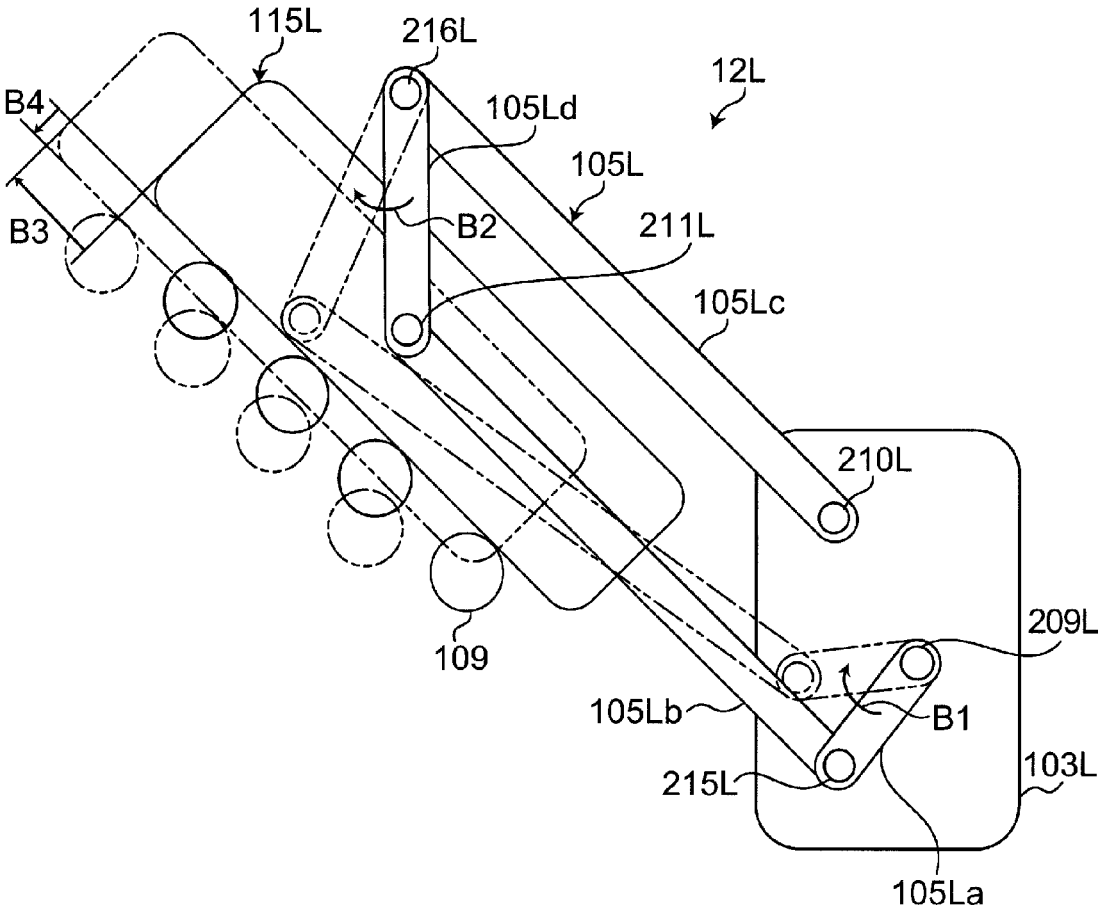
FIG. 16 is a view showing a change in the position of a working body with the rotation of a first link in the extending direction of the washing arm.
Figure 17:
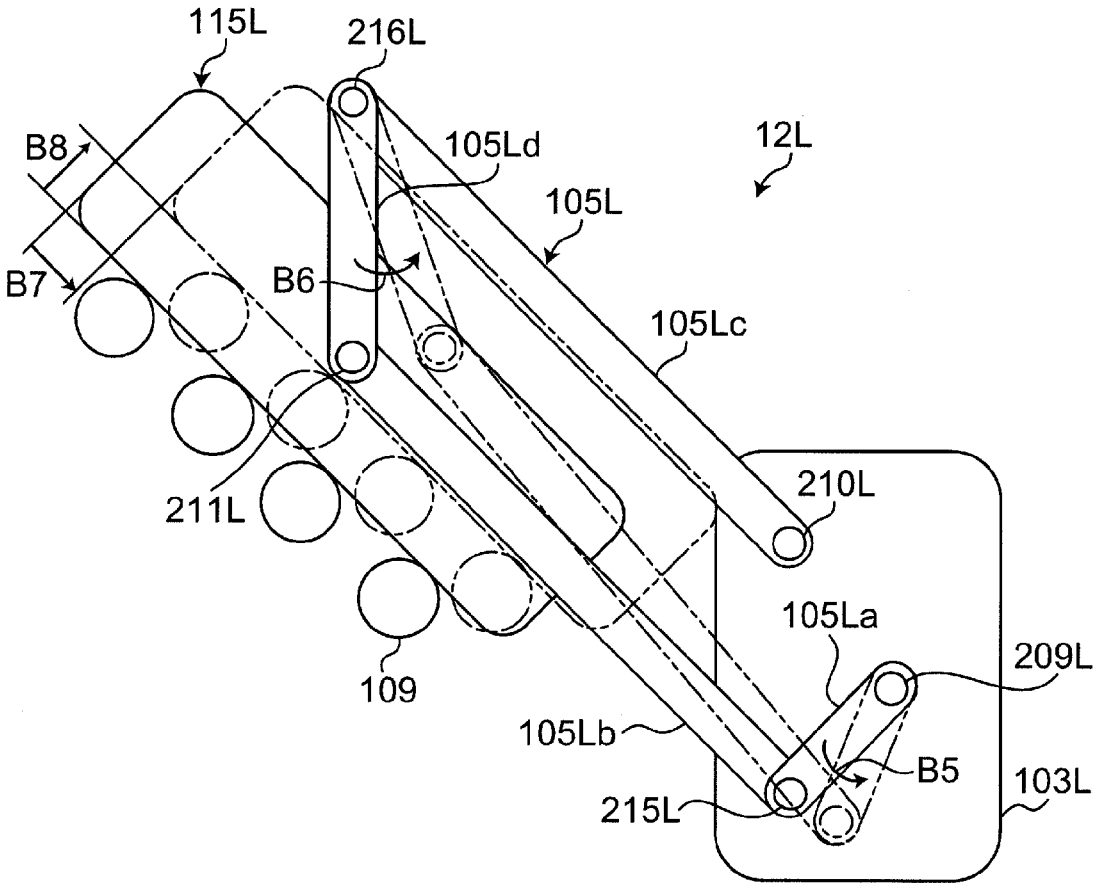
FIG. 17 is a view showing a change in the position of the working body with the rotation of the first link in the contracting direction of the washing arm.

FIG. 16 is a view showing a change in the position of the working body with the rotation of the first link in the extending direction of the washing arm. FIG. 16 and FIG. 17 described later schematically show the working body 115L, the first arm 105L, and the arm base 103L of the washing arm 12L. In this first arm 105L, the link length of the second link 105Lb is equal to the link length of the third link 105Lc, and the link length of the second link 105Lb is longer than the link length of the first link 105La.

In the washing arm 12L located as represented by solid lines in FIG. 16, when the first arm rotation shaft 209L is rotated in the direction of an arrow B1 in the state where the second arm rotation shaft 210L is fixed, the washing arm 12L moves to the position represented by chain double-dashed lines in FIG. 16 to extend the washing arm 12L. When the second arm rotation shaft 210L is rotated by a predetermined angle in the direction of the arrow B1, the fourth links 105Ld connected to the second links 105Lb rotate by a predetermined angle in the direction of an arrow B2 using the support shaft 216 as a starting point. As a result, the support shaft 211L moves away from the arm base 103L, and the working body 115L supported by the support shaft 211L also moves away from the arm base 103L. Specifically, the support shaft 211L moves with respect to the arm base 103L by a predetermined amount in the direction of an arrow B3, which is parallel to the non-deformed second link 105Lb, and the working body 115L moves with respect to the arm base 103L by a predetermined amount in the direction of the arrow B3. In this case, the support shaft 211L moves orthogonal to the non-deformed second link 105Lb by a predetermined amount in the direction of an arrow B4, and the working body 115L moves by a predetermined amount in the direction of the arrow B4. In the state where the working body 115L is in contact with the head 10 of the washed person and the second arm rotation shaft 210L is fixed, when the first arm rotation shaft 209L is rotated in the direction of the arrow B1, the pressing force of the working body 115L onto the head 10 increases with the extending operation of the washing arm 12L.

FIG. 17 is a view showing a change in the working body with the rotation of the first link in the contracting direction of the washing arm. In the washing arm 12L located as represented by solid lines in FIG. 17, when the first arm rotation shaft 209L is rotated in the direction of an arrow B5 in the state where the second arm rotation shaft 210L is fixed, the washing arm 12L moves to the position represented by chain double-dashed lines in FIG. 17 and is contracted. When the second arm rotation shaft 210L is rotated by a predetermined angle in the direction of the arrow B5, the fourth links 105Ld connected to the second links 105Lb rotates by a predetermined angle in the direction of an arrow B6 using the support shaft 216 as a starting point. As a result, the support shaft 211L moves closer to the arm base 103L, and the working body 115L supported by the support shaft 211L also moves closer to the arm base 103L. Specifically, the support shaft 211L moves by a predetermined amount with respect to the arm base 103L in the direction of an arrow B7, which is parallel to the non-deformed second link 105Lb, and the working body 115L moves with respect to the arm base 103L by a predetermined amount in the direction of the arrow B7. At this time, the support shaft 211L moves orthogonal to the non-deformed second link 105Lb by a predetermined amount in the direction of an arrow B8, and the working body 115L moves by a predetermined amount in the direction of the arrow B8. In the state where the working body 115L is in contact with the head 10 of the washed person and the second arm rotation shaft 210L is fixed, when the first arm rotation shaft 209L is rotated in the direction of the arrow B5, the pressing force of the working body 115L onto the head 10 decreases with the contracting operation of the washing arm 12L.

In the automatic head washing device 100 in each of the embodiments, in extending and contracting the washing arm 12L, there is performed the operation of rotating the first arm rotation shaft 209L in the state where the second arm rotation shaft 210L is fixed and subsequently rotating the second arm rotation shaft 210L in the state where the first arm rotation shaft 209L is fixed, or there is performed the operation of rotating the first arm rotation shaft 209L on the basis of the pressing force of the working body 115L onto the head 10, the pressing force detected by the pressure sensor. However in the automatic head washing device in accordance with the fourth embodiment, the first arm rotation shaft 209L is rotated by a predetermined amount on the basis of the rotational angle of the second arm rotation shaft 210L so as to make the pressing force of the working body 115L uniform.

Figure 18:
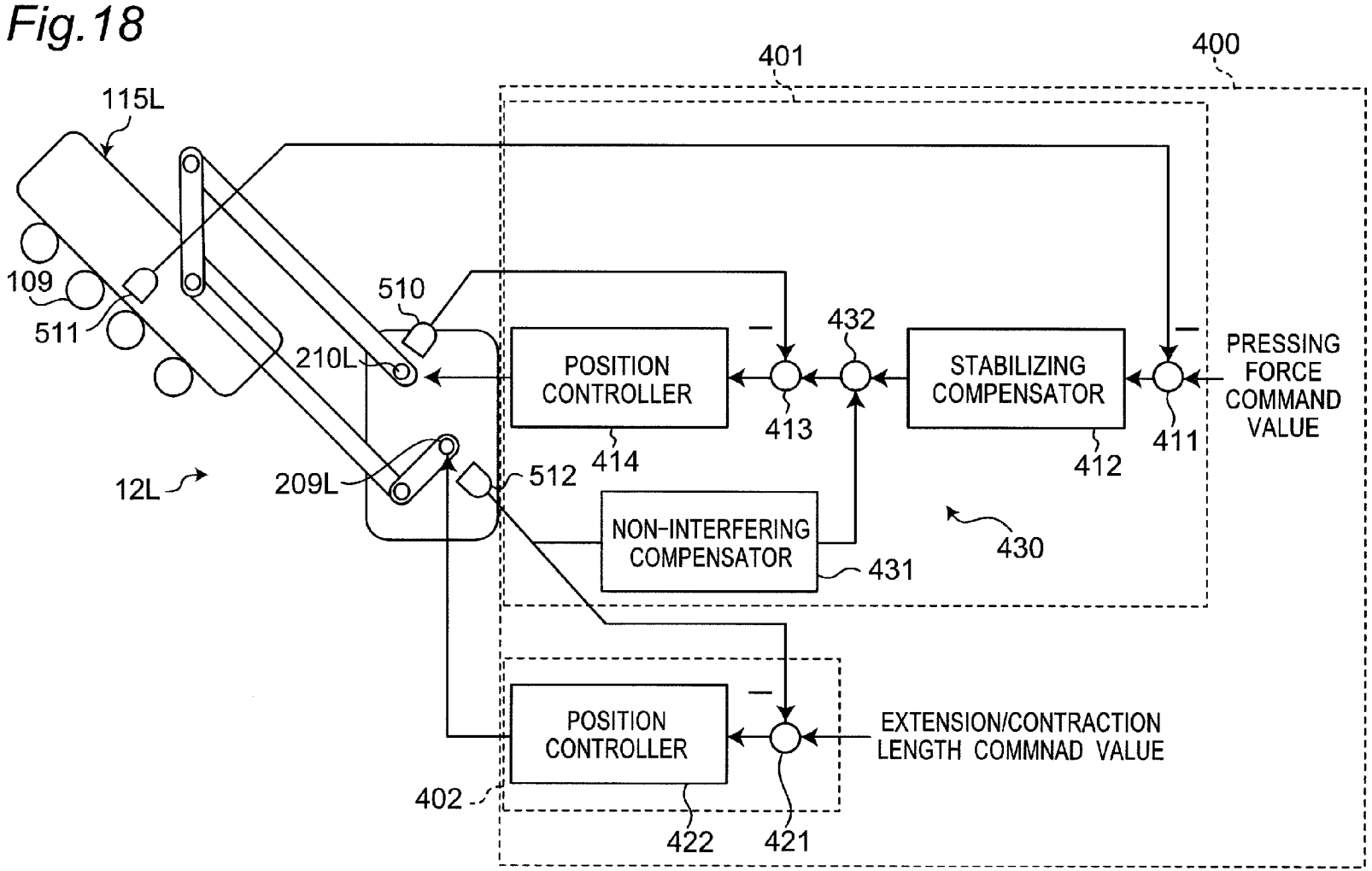
FIG. 18 is a block diagram showing configurations of a pressing force control unit and an extension/contraction length control unit of the automatic head washing device in accordance with a fourth embodiment of the present invention.

FIG. 18 is a block diagram showing configurations of a pressing force control unit and an extension/contraction length control unit of the automatic head washing device in accordance with the fourth embodiment. FIG. 18 shows control of only the washing arm 12L, but the washing arm 12R is controlled in the same manner.

As shown in FIG. 18, the control unit 400 has a pressing force control unit 401 controlling the pressing force of the working body 115L onto the head 10 of the washed person, and an extension/contraction length control unit 402 controlling an extension/contraction length of the washing arm 12L. The pressing force control unit 401 has at least a comparator 411, a stabilizing compensator 412, a comparator 413, and a position controller 414. The extension/contraction length control unit 402 has a comparator 421 and a position controller 422.

In the automatic head washing device in accordance with the fourth embodiment, the washing arm 12L is provided with a rotational sensor 510 detecting the rotational angle of the second arm rotation shaft 210L. The rotational angle of the second arm rotation shaft 210L, which is detected by the rotational sensor 510, is sent to the comparator 413.

The washing arm 12L is provided with a pressure sensor 511 detecting the pressing force of the working body 115L onto the head 10 of the washed person. The pressing force of the working body 115L onto the head 10, which is detected by the pressure sensor 511, is sent to the comparator 411.

The comparator 411 compares a pressing force command value outputted from a pressing force command value output section provided in the control unit 400 with the pressing force of the working body 115L onto the head 10, which is detected by the pressure sensor 511, to calculate an error between the both values. An error signal is sent to the comparator 413 via the stabilizing compensator 412. The stabilizing compensator 412 is formed of an integrator to stabilize a control system.

The comparator 413 compares a signal of the command value sent from the stabilizing compensator 412 with a signal of the rotational angle of the second arm rotation shaft 210L, which is detected by the rotational sensor 510, to calculate an error between the both signals. An error signal is sent to the motor 228L, which rotates the second arm rotation shaft 210L, via the position controller 414 controlling the rotational position of the second arm rotation shaft 210L. In the washing arm 12L, the control unit 400 controls the motor 228L based on the error signal to allow the working body 115L to apply a predetermined pressing force according to the pressing force command value.

In the automatic head washing device in accordance with the fourth embodiment, the washing arm 12L is provided with a rotational sensor 512 detecting the rotational angle of the first arm rotation shaft 209L. The rotational angle of the first arm rotation shaft 209L, which is detected by the rotational sensor 512, is sent to the comparator 421.

The comparator 421 compares an extension/contraction length command value outputted from an extension/contraction length command value output section provided in the control unit 400 with the rotational angle of the first arm rotation shaft 209L, which is detected by the rotational sensor 512, to calculate an error between the both values. An error signal is sent to the motor 221L, which rotates the first arm rotation shaft 209L, via the position controller 422 controlling the rotational position of the first arm rotation shaft. The control unit 400 controls the motor 221L based on the error signal, thereby allowing the washing arm 12L to be extended/contracted with a predetermined extension/contraction length according to the extension/contraction length command value.

In the automatic head washing device in accordance with the fourth embodiment, the pressing force control unit 401 of the control unit 400 includes a non-interfering compensation unit 430 executing compensation processing of suppressing variation in the pressing force of the working body 115 onto the head 10. The non-interfering compensation unit 430 has a non-interfering compensator 431 and an adder 432.

The rotational angle of the first arm rotation shaft 209L, which is detected by the rotational sensor 512, is sent to the non-interfering compensator 431. According to the rotational angle of the first arm rotation shaft 209L, which is detected by the rotational sensor 512, the non-interfering compensator 431 executes the compensation processing of the command value sent from the stabilizing compensator 412. The compensation processing is executed using information previously stored in a storage unit of the control unit 400, which corresponds to the rotational angle of the first arm rotation shaft 209L.

The storage unit of the control unit 400 includes a table in which the rotational angle of the second arm rotation shaft 210L is recorded. The rotational angle of the second arm rotation shaft 210L, which is recorded in the storage unit of the control unit 400, is the rotational angle of the second arm rotation shaft 210L, which makes the pressing force of the working body 115L supported by the support shaft 211L onto the head 10 uniform when the first arm rotation shaft 209L of the washing arm 12L is rotated by a predetermined angle.

When the first arm rotation shaft 209L is rotated by the predetermined angle to perform the extending operation of the washing arm 12L, the rotational angle of the first arm rotation shaft 209L, which is detected by the rotational sensor 512, is inputted to the non-interfering compensator 431. Then, the rotational angle of the second arm rotation shaft 210L, which makes the pressing force of the working body 115L onto the head 10 uniform, is calculated based on the rotational angle of the first arm rotation shaft 209L by using the above-mentioned table, and the calculated rotational angle is outputted to the adder 432.

The adder 432 is provided between the stabilizing compensator 412 and the comparator 413. The adder 432 adds a value outputted from the non-interfering compensator 431 to the command value sent from the stabilizing compensator 412. The command value thus corrected is sent to the comparator 413. Then, the rotation of the second arm rotation shaft 210L is controlled based on the comparison result of the comparator 413 via the position controller 414. In this manner, the washing arm 12L can be extended and contracted with a uniform pressing force.

As described above, in the automatic head washing device in accordance with the fourth embodiment, when the working body 115L is extended and contracted with respect to the arm base 103L, the control unit 400 controls the rotation of the second arm rotation shaft 210L on the basis of the rotational angle of the first arm rotation shaft 209L so as to make the pressing force of the working body 115L onto the head 10 of the washed person uniform.

The above-mentioned rotational control is feedforward control. For this reason, in the fourth embodiment, as compared to the case using feedback control, variation in the pressing force of the working body 115L onto the head 10 can be further suppressed, comfortably washing the person's head 10. According to feedback control used herein, when the working body 115L is extended and contracted with respect to the arm base 103L, the rotation of the second arm rotation shaft 209L is controlled based on the pressing force detected by the pressure sensor 511 after rotation of the first arm rotation shaft 209L so as to make the pressing force uniform. According to feedforward control used herein, the rotation of the second arm rotation shaft 210L is controlled based on the rotational angle of the first arm rotation shaft 209L, which is outputted from the rotational sensor 512 after rotation of the first arm rotation shaft 209L, so as to make the pressing force uniform.

In the automatic head control device in the fourth embodiment, when the washing arms 12L and 12R are extended and contracted, the control unit 400 performs feedforward control as described above. However, feedforward control and feedback control can be used in combination by performing feedforward control and subsequently performing feedback control to control the rotation of the second arm rotation shaft 209L on the basis of the pressing force detected by the pressure sensor 511.

Fifth Embodiment

Next, an automatic head washing device in accordance with a fifth embodiment of the present invention will be described. Only differences between the automatic head washing device in accordance with the fifth embodiment of the present invention and the automatic head washing device 100 in accordance with the first embodiment will be described. The same constituents as those in the automatic head washing device 100 in accordance with the first embodiment are not described.

Figure 19:
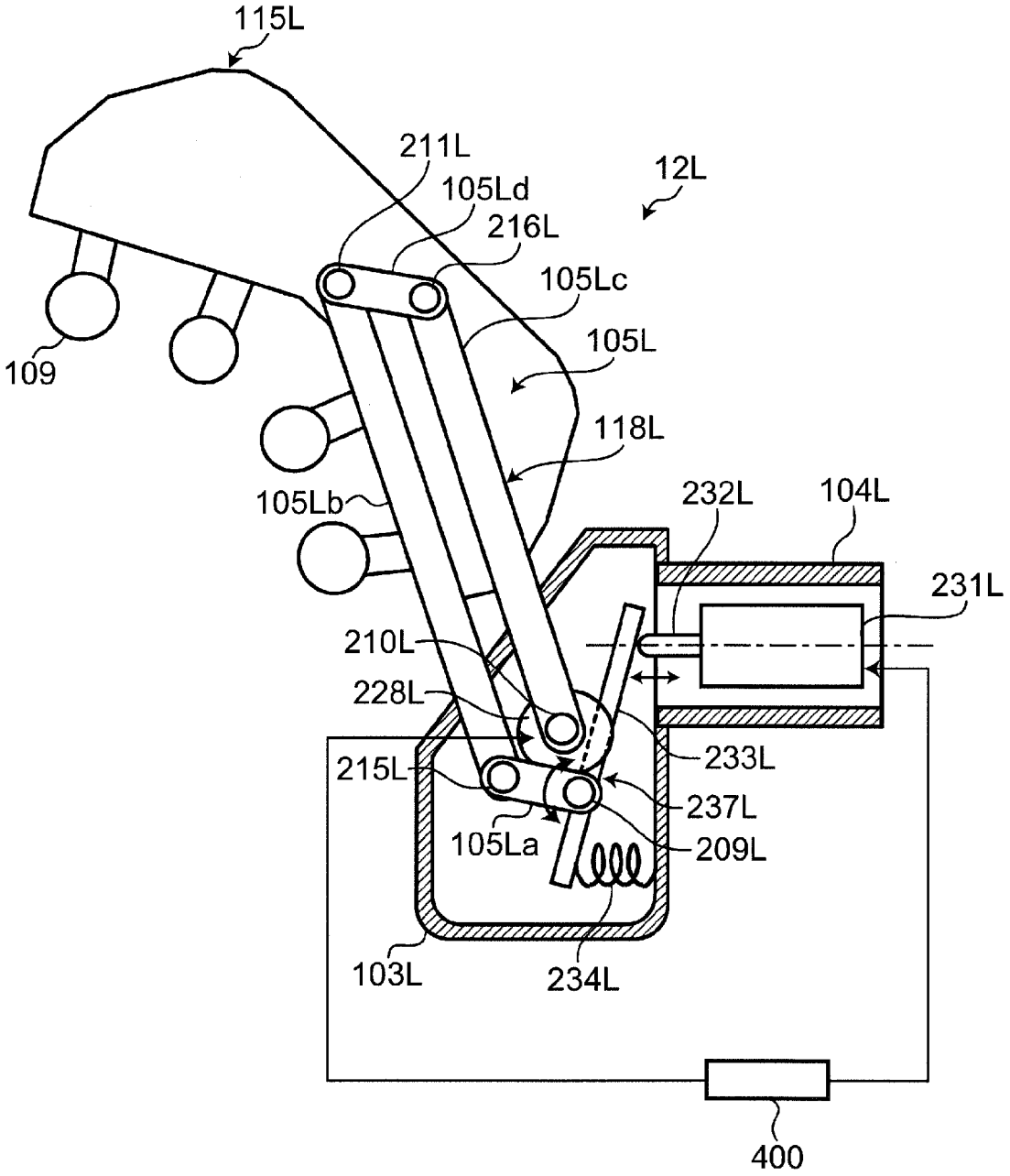
FIG. 19 is a side partial cutout view showing a washing arm of an automatic head washing device in accordance with a fifth embodiment of the present invention.
Figure 20:
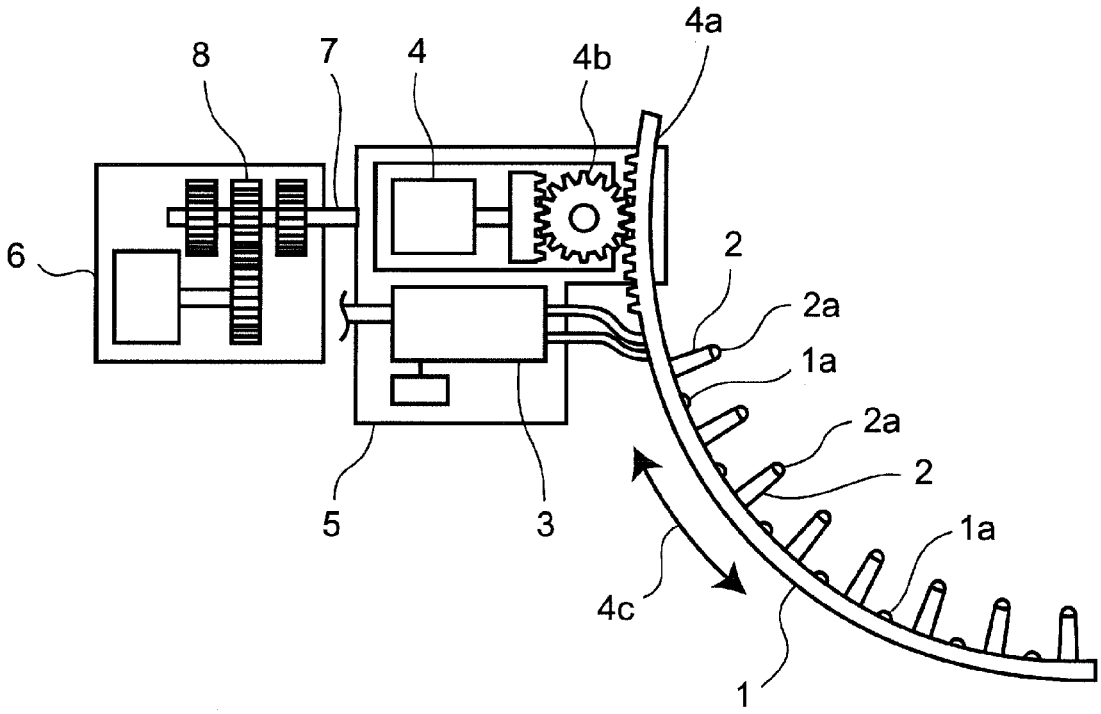
Fig.20 PRIOR ART
FIG. 20 is a view showing a schematic configuration of a main section of a conventional automatic head washing device.

FIG. 19 is a side partial cutout view showing the washing arm of the automatic head washing device in accordance with the fifth embodiment of the present invention. As shown in FIG. 19, the automatic head washing device in accordance with the fifth embodiment is provided with an extendable motor 231L as the first actuator rotating the first arm rotation shaft 209L in the automatic head washing device 100. The motor 231L is disposed in the support shaft 104L of the washing arm 12L such that an output shaft 232L matches the central axis of the support shaft 104L. The output shaft 232L can move parallel to the central axis of the support shaft 104L.

In the automatic head washing device in accordance with the fifth embodiment, a first conversion mechanism 237L converting the motion of the output shaft 232L of the motor 231L into the rotation of the first arm rotation shaft 209L is disposed in the arm base 103L. The first conversion mechanism 237L is configured of a rod member 233L that is fixed to the first arm rotation shaft 209L and has one end engaged with the output shaft of the motor 231L, and a spring 234L fixed between the other end of the rod member 233L and the arm base 103L in a compressed state.

In the first conversion mechanism 237L, when the output shaft 232L of the motor 231L extends, the first arm rotation shaft 209L rotates via the rod member 233L counterclockwise in FIG. 19. When the output shaft 232L of the motor 231L contracts, the first arm rotation shaft 209L rotates via the rod member 233L clockwise in FIG. 19. By rotating the first arm rotation shaft 209L, the motion of the output shaft 232L of the motor 231L is converted into the rotation of the first arm rotation shaft 209L. Driving of the motor 231L is controlled by the control unit 400.

The motor 231L is disposed in the support shaft 104L such that the output shaft 232L extends parallel to the support shaft 104L and thus, need not be disposed in the arm base 103L. Accordingly, in the fourth embodiment, as compared to the case where the motor 231L is disposed in the arm base 103L, the arm base 103L can be made more compact.

The present invention is not limited to the illustrated embodiments, and as a matter of course, may be variously improved and changed in design so as not to deviate from the subject matter of the present invention.

INDUSTRIAL APPLICABILITY

An automatic head care device and an automatic head care method according to the present invention can be widely used in the medical field and in the industry of beauty care in which a person's head is being cared, which is useful.

DESCRIPTION OF REFERENCE SYMBOLS

10 head
11 head support
12, 12L, 12R washing arm
100 automatic head washing device
101 bowl
102L, 102R support column
103L, 103R arm base
104L, 104R, 211L, 211R, 215L, 215R, 216L, 216R support shaft
105L, 105R first arm
105La, 105Ra first link
105Lb, 105Rb second link
105Lc, 105Rc third link
105Ld, 105Rd fourth link
109 contact
115L, 115R working body
116L, 116R housing
118L, 118R five-joint link mechanism
201L, 201R, 221L, 228L, 231L, 301L motor
209L, 209R first arm rotation shaft
210L, 210R second arm rotation shaft
222L, 232L output shaft
227L, 237L first conversion mechanism
223L worm
224L worm wheel
400 control unit

The invention claimed is:

1. An automatic head care device comprising:

a base having a head support supporting a person's head;

independently rotated first rotational driving shaft and second rotational driving shaft;

a first link having one end fixed to the first rotational driving shaft;

a second link having one end rotatably connected to another end of the first link;

a third link having one end fixed to the second rotational driving shaft;

a fourth link having one end rotatably connected to another end of the third link;

a working shaft rotatably connecting another end of the second link to another end of the fourth link;

a working body caring the person's head supported by the head support, the working body being rotatably supported by the working shaft; and a control unit controlling rotation of the first rotational driving shaft and the second rotational driving shaft.

2. The automatic head care device according to claim 1, wherein the control unit rotates the first rotational driving shaft and the second rotational driving shaft to cause the working body to make contact with the person's head supported by the head support.

3. The automatic head care device according to claim 2, further comprising:

an arm base rotatably holding the first rotational driving shaft and the second rotational driving shaft, the shafts being coupled to the working body; and a support shaft fixed to the arm base, the support shaft being rotatably attached to the base, wherein the control unit controls rotation of the first rotational driving shaft and the second rotational driving shaft to enable the working body to be extended and contracted with respect to the arm base.

4. The automatic head care device according to claim 3, wherein when the working body is extended and contracted with respect to the arm base, the control unit controls rotation of the second rotational driving shaft on the basis of a rotational angle of the first rotational driving shaft so as to make a pressing force of the working body onto the head uniform.

5. The automatic head care device according to claim 1, wherein a ratio of a link length of the first link to a link length of the fourth link is 1:1.

6. The automatic head care device according to claim 5, wherein a ratio among the link length of the first link, a link length of the second link, a link length of the third link, and the link length of the fourth link is 1:4:3.5:1.

7. The automatic head care device according to any onc of claim 1, further comprising:

a first actuator rotating the first rotational driving shaft; and a second actuator rotating the second rotational driving shaft, wherein the control unit controls operation of the first actuator and the second actuator so as to confine an angle between the first link and the third link within a range of 90±60 degrees.

8. The automatic head care device according to claim 7, further comprising a first conversion mechanism converting motion of an output shaft of the first actuator into rotation of the first rotational driving shaft, wherein the first actuator is disposed such that the output shaft extends parallel to the support shaft of the first actuator.

9. The automatic head care device according to claim 8, wherein the first conversion mechanism has a worm and a worm wheel converting rotation of the output shaft of the first actuator into rotation of the first rotational driving shaft.

10. The automatic head care device according to claim 7, further comprising:

a current detection unit detecting a current value to drive the second actuator; and a second conversion mechanism reversibly converting motion of an output shaft of the second actuator into rotation of the second rotational driving shaft, wherein the control unit calculates a force applied to the second actuator on the basis of a change in the current value detected by the current detection unit.

11. The automatic head care device according to claim 3, wherein the working body is a working body washing a person's head, and the control unit rotates the support shaft to cause the working body to swing in a forward and rearward direction of the person's head supported by the head support, thereby washing the person's head.

12. The automatic head care device according to claim 11, further comprising a nozzle ejecting water or hot water to the person's head supported by the head support, wherein the control unit causes the nozzle to eject water or hot water and the working body to swing, thereby washing the person's head.

13. An automatic head care method using an automatic head care device including: a base having a head support supporting a person's head; independently rotated first rotational driving shaft and second rotational driving shaft; a first link having one end fixed to the first rotational driving shaft; a second link having one end rotatably connected to another end of the first link; a third link having one end fixed to the second rotational driving shaft; a fourth link having one end rotatably connected to another end of the third link; a working shaft rotatably connecting another end of the second link to another end of the fourth link; a working body rotatably supported by the working shaft; an arm base rotatably holding the first rotational driving shaft and the second rotational driving shaft; and a support shaft fixed to the arm base, the support shaft being rotatably attached to the base, the method comprising controlling rotation of the first rotational driving shaft and the second rotational driving shaft to cause the working body to make contact with the person's head supported by the head support, thereby caring the person's head.

14. The automatic head care method according to claim 13, further comprising controlling rotation of the first rotational driving shaft and the second rotational driving shaft to cause the working body to be extended and contracted with respect to the arm base.

15. The automatic head care method according to claim 13, wherein the working body is a working body washing a person's head, and the method further comprising rotating the support shaft to cause the working body to swing in a forward and rearward direction of the person's head supported by the head support, thereby washing the person's head.

16. The automatic head care method according to claim 15, further comprising providing a nozzle ejecting water or hot water to the person's head supported by the head support; and ejecting water or hot water from the nozzle and swinging the working body to wash the person's head.

* * * * *